US008231263B2

(12) United States Patent
Windhab et al.

(10) Patent No.: US 8,231,263 B2
(45) Date of Patent: Jul. 31, 2012

(54) CYLINDRICAL MEMBRANE APPARATUS FOR FORMING FOAM

(75) Inventors: Erich Josef Windhab, Hemishofen (CH); Nadina Patrizia Müller-Fischer, Satfen (CH); Karl Uwe Tapfer, Danville, CA (US)

(73) Assignee: Nestec S.A., Vevey (CH)

( * ) Notice: Subject to any disclaimer, the term of this patent is extended or adjusted under 35 U.S.C. 154(b) by 556 days.

(21) Appl. No.: 12/374,284

(22) PCT Filed: Jul. 12, 2007

(86) PCT No.: PCT/EP2007/057191

§ 371 (c)(1),
(2), (4) Date: Jan. 16, 2009

(87) PCT Pub. No.: WO2008/009623

PCT Pub. Date: Jan. 24, 2008

(65) Prior Publication Data

US 2009/0323459 A1 Dec. 31, 2009

Related U.S. Application Data

(60) Provisional application No. 60/831,603, filed on Jul. 17, 2006.

(51) Int. Cl.
*B01F 3/04* (2006.01)

(52) U.S. Cl. ..... 366/105; 264/41; 264/50

(58) Field of Classification Search ..... 366/105; 264/41, 50

See application file for complete search history.

(56) References Cited

U.S. PATENT DOCUMENTS 2,876,104 A 3/1959 Bliudzius ..... 99/236

(Continued)

FOREIGN PATENT DOCUMENTS

DE 101 27 075 A1 12/2002

(Continued)

OTHER PUBLICATIONS

International Search Report PCT/EP2007/057191 Dated Oct. 22, 2007.

(Continued)

*Primary Examiner* — Joseph Del Sole
*Assistant Examiner* — James Sanders
(74) *Attorney, Agent, or Firm* — Winston & Strawn LLP

(57) ABSTRACT

An apparatus and process for making a foam having a controlled size distribution of gas bubbles in a liquid matrix. The invention utilizes a porous material having a controlled pore size and pore distance to produce a substantially uniform size distribution of gas bubbles; a gas pumping device for directing a flow of gas to and through the porous material to form the gas bubbles; a fluid pumping device for directing a flow of liquid matrix past the porous material and a rotating element moving in the vicinity of the membrane surface causing an additional flow to detach, collect accumulate and entrain the gas bubbles in the liquid matrix to form a foam having gas bubbles of generally uniform size and a substantially uniform gas bubble size distribution. Advantageously, the pore size and pore distance of the porous material, the gas flow from the gas pumping device, the flow field generated by the rotating element and the liquid flow from the fluid pumping device cooperate to provide gas bubbles having a mean diameter $X_{50,0}$ that is less than 2-2.5 times, preferably less than 1.25-1.5 times the mean pore diameter of the membrane and to provide the foam with a gas bubble diameter distribution ratio $X_{90,0}/X_{10,0}$ that is less than 5, preferably less than 3.

27 Claims, 20 Drawing Sheets

U.S. PATENT DOCUMENTS

| | | | | |
|---|---|---|---|---|
| 3,118,958 | A | 1/1964 | White | |
| 3,936,391 | A | 2/1976 | Gabby et al. | 252/356 |
| 4,174,907 | A * | 11/1979 | Suh et al. | 366/279 |
| 5,215,777 | A | 6/1993 | Asher et al. | 426/565 |
| 5,345,781 | A | 9/1994 | Fels et al. | 62/343 |
| 5,620,732 | A | 4/1997 | Clemmings et al. | 426/565 |
| 5,713,209 | A | 2/1998 | Hunchar et al. | 62/68 |
| 5,919,510 | A | 7/1999 | Fayard et al. | 426/565 |
| RE36,390 | E | 11/1999 | Fels et al. | 62/68 |
| 6,010,734 | A | 1/2000 | Whelan et al. | 426/565 |
| 6,120,813 | A | 9/2000 | Barnes et al. | 426/66 |
| 6,228,412 | B1 | 5/2001 | Groux et al. | 426/516 |
| 6,368,652 | B1 | 4/2002 | Heertje et al. | 426/601 |
| 6,436,460 | B1 | 8/2002 | Daniel et al. | 426/565 |
| 6,491,960 | B1 | 12/2002 | Daniel et al. | 426/565 |
| 6,497,913 | B1 | 12/2002 | Gray et al. | 426/565 |
| 6,511,694 | B2 | 1/2003 | Huang et al. | 426/565 |
| 6,558,729 | B1 | 5/2003 | Riviere et al. | 426/565 |
| 6,565,908 | B1 | 5/2003 | Daniel et al. | 426/565 |
| 6,572,084 | B1 * | 6/2003 | Ivanovich et al. | 261/64.1 |
| 6,596,333 | B1 | 7/2003 | Vaghela et al. | 426/565 |
| 7,591,452 | B2 * | 9/2009 | Kohama et al. | 261/96 |
| 2001/0041211 | A1 | 11/2001 | Beeson et al. | 426/602 |
| 2002/0128336 | A1 | 9/2002 | Kolb et al. | 521/50 |
| 2003/0134025 | A1 | 7/2003 | Vaghela et al. | 426/565 |
| 2009/0263555 | A1 | 10/2009 | Tapfer et al. | 426/564 |
| 2009/0311406 | A1 | 12/2009 | Tapfer et al. | 426/565 |
| 2010/0055266 | A1 | 3/2010 | Windhab et al. | 426/317 |

FOREIGN PATENT DOCUMENTS

| | | | |
|---|---|---|---|
| EP | 0 723 806 | B1 | 10/2001 |
| EP | 1 284 106 | A2 | 2/2003 |
| EP | 1 319 435 | A2 | 6/2003 |
| EP | 1 520 484 | A1 | 4/2005 |
| EP | 1 520 485 | A1 | 4/2005 |
| EP | 1 650 133 | A1 | 4/2006 |
| GB | 694918 | | 7/1953 |
| WO | WO 92/09209 | | 6/1992 |
| WO | WO 95/35035 | | 12/1995 |
| WO | WO 01/45830 | A1 | 6/2001 |
| WO | WO 2004/030799 | A1 | 4/2004 |
| WO | WO 2005/013713 | A1 | 2/2005 |

OTHER PUBLICATIONS

Souci, Rachmann, Kraut, "Food Composition and Nutrition Tables," Medpharm Scientific Publishers, Stuttgart, p. 5 (2000).

Chilean Patent Application No. CL-2087-07, filed Jul. 17, 2007 (English in corresponding to U.S. Appl. No. 60/831,606 and U.S. 2009/0263555 A1).

Chilean Patent Application No. CL-2086-07, filed Jul. 17, 2007 (English in corresponding to U.S. Appl. No. 60/831,607 and U.S. 2010/055266 A1).

Chilean Patent Application No. CL-2088-07, filed Jul. 17, 2007 (English in corresponding to U.S. Appl. No. 60/831,609 and U.S. 2009/0311406 A1).

International Search Report PCT/EP2007/057172 dated Feb. 4, 2008.

International Search Report PCT/EP2007/057175 dated Dec. 18, 2007.

International Search Report PCT/EP2007/057177 dated Jan. 11, 2008.

"Toxicological evaluation of some antimicrobials, antioxidants, emulsifiers, stabilizers, flour treatment agents, acids and bases". Ninth and Tenth Reports of the Joint FAO/WHO Expert Committee on Food Additives, published 1966 and 1967. pp. 1-5.

"New Developments in Crystallization Processing", Windhab, Journal of Thermal Analysis and Calorimetry vol. 57, pp. 171-180 (1999).

Non-final Office Action U.S. Appl. No. 12/374,271 dated Sep. 2, 2011.

Non-final Office Action U.S. Appl. No. 12/374,280 dated Apr. 6, 2012.

Non-final Office Action U.S. Appl. No. 12/374,266 dated Oct. 24, 2011.

* cited by examiner

Swollen lamellar phase structure of poly glycerol ester of fatty acid + free fatty acids 1. Heat treatment (80°C, 30s)
2. pH-adjustment (6.8)

1. pH-adjustment (6.8)
2. Heat treatment (80°C, 30s)

After 5 heat shock cycles
6h: -20°C -> 6h: -2°C (5x)

Freshly produced
+ frozen

CYLINDRICAL MEMBRANE APPARATUS FOR FORMING FOAM

This application is a 371 filing of International Patent Application PCT/EP2007/057191 filed Jul. 12, 2007, which claims the benefit of application No. 60/831,603 filed Jul. 17, 2006.

BACKGROUND OF THE INVENTION

The present invention relates to stable foams having a controlled fine air bubble size distribution and to edible products prepared therefrom having a low fat content. Particularly interesting products prepared from such foams include ice creams and related frozen products.

The manufacture of finely dispersed gas bubbles in a continuous liquid or semi solid fluid phase either denoted as gas dispersions for gas volume fractions below about 10-15%, or as foams for gas volume fractions higher than about 15-20% is of major interest in particular in the food, pharmaceutical, cosmetics, ceramics and building material industries. The gas fraction in related products of these industries has a strong impact on the physical parameters like density, rheology, thermal conductivity and compressibility and related application properties. In the area of foods, aeration of liquid to semi-solid systems adds value with respect to consistency and related perception/sensory properties like creaminess, softness and smoothness as well as improved shape retention and de-mixing stability. For specific food systems like frozen deserts or ice cream the strongly reduced thermal conductivity is another major stability factor protecting the product from quickly melting; e.g. due to thermal shocks applied in the "cooling chain" from the store to the consumer's refrigerator. The strong increase of inner interface may also give access to new area for adsorption and fixation/stabilization of functional/techno-functional molecules such as flavor and/or nutritionally active compounds.

In conventional frozen and aerated water-based ice slurries of the ice cream type, the typically important sensory properties like scoop ability, creaminess, smoothness, shape retention during melting and heat shock stability are determined by an interplay of the three disperse phases: air cells/bubbles, fat globules/fat globule agglomerates and water ice crystals within characteristic size ranges and volume fractions of these disperse components as shown for example in Table 1.

TABLE 1

Size and volume fraction ranges of disperse phases in conventional ice cream

| | gas/air cells | fat globule agglomerates | water ice crystals |
|---|---|---|---|
| Mean diameter $X_{50,0}$/μm | 25-35 | 2-100 | 50-60 |
| volume fraction/ % vol. | 50-60 | 8-15 | 40-50 |

Well-stabilized small air cells are mainly responsible for the creaminess and smooth texture sensation during the melting of the ice cream in a consumer's mouth. Smaller air cells/foam structure in the melted state during shear treatment between tongue and palate results in a more pronounced perception of creaminess. Smaller air cell size also supports longer shelf life of frozen ice cream systems due to increased steric hindrance for ice crystal growth. At constant gas volume fraction a higher number of smaller air cells generates a larger total gas interface area and thus reduced thickness of lamellae formed between the air cells by the continuous watery fluid phase. This restricts ice crystal growth within these lamellae. Another but less pronounced direct contribution to creaminess is derived from medium sized fat globule agglomerates below 20-30 micron in diameter. When the fat globule aggregates get larger than about 30-50 microns, the creamy sensation turns into a buttery, fatty mouth feel.

The scoop ability of frozen, aerated slurries like ice creams is mainly related to the ice crystal structure, in particular the ice crystal size and their interconnectivity. Scoop ability is the most relevant quality characteristic of ice cream in the low temperature range between −20° C. and −15° C.

In conventional ice cream manufacture partial freezing is done in continuous or batch freezers, having cooled scraped surface heat exchangers, down to outlet temperatures of about −5° C. Then the ice cream slurry is filled into cups or formed at the outlet of extrusion dies. Thereafter the products are hardened in freezing tunnels with coolant air temperatures of around −40° C. until a product core temperature of about −20° C. is reached. Then the products are stored and/or distributed. After pre-freezing of conventional ice cream recipes in the ice cream freezer, about 40-45% of the freezable water is frozen as water ice crystals. Another fraction of about 55-60% of the freezable water is still liquid due to freezing point depression in the watery solution concentrated in sugars, polysaccharides and proteins. Most of this watery fraction freezes during further cooling in the hardening tunnel. In this hardening step, the ice cream is in the state of rest. Consequently the additionally frozen water crystallizes at the surfaces of the existing ice crystals, causing their growth from about 20 microns to 50 microns and larger. Some of the ice crystals interconnect to form a three dimensional ice crystal network. When such networks are formed, the ice cream behaves like a solid body and its scoop ability diminishes.

Certain patents such as U.S. Pat. Nos. 5,620,732; 6,436,460; 6,491,960; 6,565,908 disclose the restricting of ice crystal growth during cooling/hardening by the use of antifreeze proteins. This is also expected to have a positive impact on the ice crystal connectivity with respect to improved scoop ability.

U.S. Pat. Nos. 6,558,729, 5,215,777, 6,511,694 and 6,010,734 disclose the use of other specific ingredients like low melting vegetable fat, polyol fatty acid polyesters or specific sugars like sucrose/maltose mixtures to soften the related ice cream products, thus improving scoop ability and creaminess.

U.S. Pat. Nos. 5,345,781, 5,713,209, 5,919,510, 6,228,412 and RE36,390 disclose specific processing equipment, mostly single or twin screw continuous freezing extruders, to refine the ice cream microstructure (air cells, ice crystals and fat globule agglomerates) by using high viscous friction forces acting at the typically very low processing temperatures of 10° C. to −15° C. and thus improving the texture and stability properties.

Other publications disclose the use of mesomorphic surfactant phases with a premix having surfactants and water being prepared at specified temperature to provide a continuous lamellar phase. These documents include European patent application 753,995 and PCT publication WO95/35035. Another approach that discloses the use of mesomorphic phases of edible surfactant as structuring agents and/or fat substitutes can be found in U.S. Pat. No. 6,368,652, European patent application 558,523 and PCT publication WO92/09209.

PCT publication WO2005/013713 discloses an ice confection having at least 2% by weight fat and its manufacturing process, where some of all of fat are present as oil bodies.

Despite these disclosures, however, there remains a need for a process to form iced foams or iced confections that when frozen do not undergo pronounced gas bubble enlargement and its associated generation of pronounced solid body behavior or iciness.

Furthermore, novel aeration techniques to address the above need remain lacking. For example, industrial membrane based aeration technology is still rather new. Known conventional aeration or whipping of liquid fluid systems is commonly carried out using rotor/stator dispersive mixing devices in turbulent flow fields under very high energy input rate conditions.

Membrane based dispersing procedures are known in the area of liquid/liquid dispersing (emulsification) using static membrane modules in which the detachment of disperse liquid droplets is caused by membrane overflow with the continuous liquid phase. However this means that the forces or stresses supporting drop detachment are directly coupled with the volume flow rate of the continuous fluid phase. This is certainly not acceptable for the manufacture of related emulsion or dispersion systems if changes in volume flow rate would also impact on the drop size distribution of the disperse phase thus changing related system properties.

First attempts in membrane foaming have also been introduced using static membrane devices with the same type of problems as described for the liquid/liquid dispersion processing above, however with more pronounced problems concerning the generation of small bubbles in particular at higher gas volume fractions (>30-40%). This may be based on a well known physical relationship, described by the so-called critical Capillary Number ($Ca_c$). The major type of flow generated in the vicinity (i.e., Prandt1 boundary layer) of an overflow static membrane is shear flow. In shear flow the critical Capillary Number is a strong function of the viscosity ratio of disperse and continuous phases ($\eta_{disperse}/\eta_{continuous}$). In particular for very low viscosity ratio in the range of $\leqq 10^{-3}$-$10^{-4}$ representing foam systems, $Ca_c$ can reach values larger than about 10-30. The reason is that in spite of easy and large deformation of air bubbles in sheared liquids, there is no efficient break up, or in other words, the critical bubble deformation is strongly increasing with decreasing viscosity ratio. At very high volume flow rates turbulent flow conditions are reached with improved bubble dispersion. This is not satisfactory, however, with regard to bubble size and narrow bubble size distribution width. Even in the turbulent flow domain a laminar Prandt1 layer exists in the vicinity of the walls, thus limiting the turbulent dispersing mechanism.

Recently a rotating membrane device has been introduced for liquid/liquid dispersing showing the high potential of improved drop dispersing in particular with respect to small and narrowly size distributed droplets, but this device has not been used for gas dispersing or foaming. This is likely due to the problems related to the difficult gas bubble break up in shear dominated laminar flow described above, as well as due to the high density difference between the two phases which makes the process in rotational, particularly laminar flow fields, even more difficult. The gas phase having less than one percent of the liquid density tends to separate towards smaller radii (equivalent to lower centrifugal pressure) in the centrifugal force field acting in laminar rotational flows without flow-related disturbance. Such fundamental problems remain unsolved.

German patent application DE 101 27 075 discloses a rotating membrane device for the manufacture of emulsion systems. This device is not suitable, however, for the generation of finely dispersed homogeneous gas dispersions or foams due to the large radial dimensions of the dispersing gaps formed between the membrane modules and the housing, which would strongly support the de-mixing of the phases at higher rotational velocity required for the refinement of the gas bubbles.

PCT publications WO 2004/30799 and WO 01/45830 describe similar membrane devices for emulsion production with identical problems to those of gas dispersions or foams that were previously mentioned.

There is therefore a need for a novel aeration device and method to enable the formation of a low fat frozen foam product that when frozen does not form large gas bubbles or interconnected ice crystals and their subsequent solid body behavior. There is also a need for products that contain such a novel foam.

SUMMARY OF THE INVENTION

The invention relates to an apparatus for making a foam having a controlled size distribution of gas bubbles in a liquid matrix, comprising a porous material having a controlled pore size to produce a substantially uniform size distribution of gas bubbles; a gas pumping device for directing a flow of gas to and through the porous material to form the gas bubbles; a fluid pumping device for directing a flow of liquid matrix past the porous material and a rotating element, variable but adjustable in circumferential velocity, causing flow in the vicinity of the porous material to detach from the porous material, collect, accumulate and entrain the gas bubbles in the liquid matrix to form a foam having gas bubbles of generally uniform size and a substantially uniform gas bubble size distribution. Advantageously, the pore size of the porous material, the gas flow from the gas pumping device, the liquid flow from the fluid pumping device and the additional flow caused by the rotating element close to the surface of the porous material cooperate to provide gas bubbles having a mean diameter $X_{50,0}$ that is in the range of 1.5 to 2 times the mean pore diameter Xp of the porous material and to provide the foam with a gas bubble diameter distribution ratio $X_{90,0}/X_{10,0}$ that is less than 5 without the additional rotational flow and cooperate to provide gas bubbles having a mean diameter $X_{50,0}$ that is in the range of 1.25 to 1.5 times the mean pore diameter Xp of the porous material and to provide the foam with a gas bubble diameter distribution ratio $X_{90,0}/X_{10,0}$ that is less than 3, preferably less than 2 with the additional rotational flow.

Preferably, the porous material is a membrane that is configured, dimensioned, positioned and eventually moved to allow the flow of gas to pass therethrough and form gas bubbles on the membrane surface and to facilitate detachment of the gas bubbles from the membrane surface by the overflowing liquid matrix for entrainment in this liquid matrix. Suitable porous membranes may be made of a metal, ceramic, glass, polymer or rubber material and have pore diameters ranging from 0.1 to 10 microns; an average pore diameter; and a narrow pore size distribution characterized by a maximum to minimum pore diameter ratio of less than 1.5, and a controlled pore distance that is at least 3 times, but preferably more than 5 times the average pore diameter.

The porous membrane may be configured in the shape of a cylinder and the apparatus further comprises a housing that includes a wall having a surface that is configured and dimensioned to be adjacent the porous membrane cylinder to form a narrow gap of constant width between the porous membrane cylinder and the housing wall surface. Preferably, at least one drive member is provided for rotating the cylinder or housing, or both in order to detach the gas bubbles from the porous membrane surface and to entrain the gas bubbles in the liquid matrix. Also, the gap may have a width of about 0.1 to 10 millimeters.

In one embodiment, the cylinder surface where the gas bubbles are formed is an exterior surface of the cylinder, the adjacent wall of the housing is an inner wall, the porous membrane cylinder is rotated, and the drive member provides rotation at a circumferential velocity of 1 to 40 m/s, with the rotating exterior surface of the cylinder in connection with the passing liquid matrix dislodging the gas bubbles and entraining them in the liquid matrix. Alternatively, the cylinder surface where the gas bubbles are formed is an interior surface of the membrane cylinder and the wall of the housing surrounds the membrane cylinder. Via the gap between the housing wall and the membrane cylinder the gas is pumped through the membrane. A rotating element, preferably another (non-membrane) cylinder is concentrically or eccentrically located within the membrane cylinder so that the flow caused by the rotating element (cylinder) supports the flow of the liquid matrix which is directed to pass by the interior surface of the membrane cylinder to remove the gas bubbles and entrain them in the liquid matrix.

In case of the concentric inner non-membrane cylinder arrangement, the gap width is fixed in the range of 0.1 to 10 millimeters to provide adjustability in the selection of the gas bubble size or size distribution.

In case of the eccentric inner non-membrane cylinder arrangement, the eccentric flow gap has a width ratio of largest gap width to smallest gap width of 1.1 to 5 to provide adjustability in the selection of the gas bubble size or size distribution.

In addition, either the fluid pumping device provides a variable, adjustable mass flow rate of the matrix liquid, the gas pumping device directs the gas through the membrane with a variable, adjustable trans-membrane pressure and gas volume- or mass flow rate, and/or the variable, adjustable circumferential velocity of the rotating element or cylinder provide adjustability in the selection of the gas bubble size or size distribution. The invention also relates to a process for making a foam having a controlled size distribution of gas bubbles in a liquid matrix, which comprises passing a flow of a gas to and through a porous material having a controlled pore size and pore distance to produce a substantially uniform size distribution of gas bubbles; and passing a flow of liquid matrix past the porous material to detach, collect, accumulate and entrain the gas bubbles in the liquid matrix to form the foam. In this process, the pore size of the porous material, the gas flow from the gas pumping device the liquid flow from the fluid pumping device and the circumferential velocity of the rotating element close to the surface of the porous material are selected separately or in combination to provide gas bubbles having a mean diameter $X_{50,0}$ that is in the range of 2-2.5 times the mean pore diameter Xp and to provide the foam with a gas bubble diameter distribution ratio $X_{90,0}/X_{10,0}$ that is less than 5 without the additional rotational flow caused by the rotating element and to provide gas bubbles having a mean diameter $X_{50,0}$ that is in the range of 1.25-1.5 times the mean pore diameter Xp and to provide the foam with a gas bubble diameter distribution ratio $X_{90,0}/X_{10,0}$ that is less than 3, preferable less than 2 with the additional rotational flow.

When the liquid matrix comprises water, the gas is air, and the membrane is rotated with an optimally adjusted circumferential velocity the foam can be provided with a highly desirable gas bubble diameter distribution ratio $X_{90,0}/X_{10,0}$ that is below 2.

As in the apparatus, the porous material is typically a membrane that is configured, dimensioned, positioned and eventually moved to allow the flow of gas to pass therethrough and form gas bubbles on a surface thereof, and the liquid flow generated by the fluid matrix passing through a gap formed between the porous membrane and a wall surface and eventually an additional flow caused by variable, adjustable rotational motion of a rotating element help to carry the gas bubbles away. The porous membrane is advantageously configured in the shape of a cylinder and the gap has a constant width between the porous membrane cylinder and the housing wall surface. The process further comprises rotating the cylinder, the wall, or both in order to detach the gas bubbles from the porous membrane surface and to entrain the gas bubbles in the liquid matrix. The cylinder can be rotated at a circumferential velocity of 1 to 40 m/s, with the rotating exterior surface of the cylinder in connection with the passing liquid matrix dislodging the gas bubbles and entraining them in the liquid matrix. Alternatively, the cylinder surface where the gas bubbles are formed may be an interior surface of the membrane cylinder, and the housing interior surface with the exterior surface of the membrane cylinder then form a gap through which the gas flow enters into and through the membrane. In that arrangement a rotating element, preferably a second non-membrane cylinder is located concentrically or eccentrically within the membrane cylinder forming a gap of 0.1-10 mm width in case of the concentric placement and in the eccentric case forming a gap having a width ratio of largest gap width to smallest gap width of 1.1 to 5, so that the liquid matrix is directed to pass by the interior surface of the cylinder to remove the gas bubbles and entrain them in the liquid matrix.

The process can be conducted by adjustably selecting gas bubble size or size distribution by selecting a membrane with distinct pore size distribution and pore distance and controlling the flow of the liquid matrix at a variable, adjustable mass flow rate, controlling the gas flow through the membrane at a variable, adjustable trans-membrane pressure and gas volume- or mass flow rate and controlling the additional flow caused by a variable, adjustable rotational motion of the rotating element (cylinder), moving close to the membrane surface. Such additional rotational flow applied by the rotating element is highly advantageous, because it decouples product throughput rate and bubble detaching stresses acting at the membrane surface and determining the resulting bubble size. Further, the desired gas bubble size and gas bubble size distribution may be attained within a range of disperse gas volume fractions of 20 to 70% equivalent to overruns of 25 to 230%.

BRIEF DESCRIPTION OF THE DRAWINGS

For a further understanding of the nature and advantages of the invention as well as related advantages compared to the state of the art, reference should be made to the following description taken in conjunction with the accompanying figures in which the invention and invention-related properties are exemplary demonstrated, wherein.

DETAILED DESCRIPTION OF THE PREFERRED EMBODIMENTS

Figure 1:
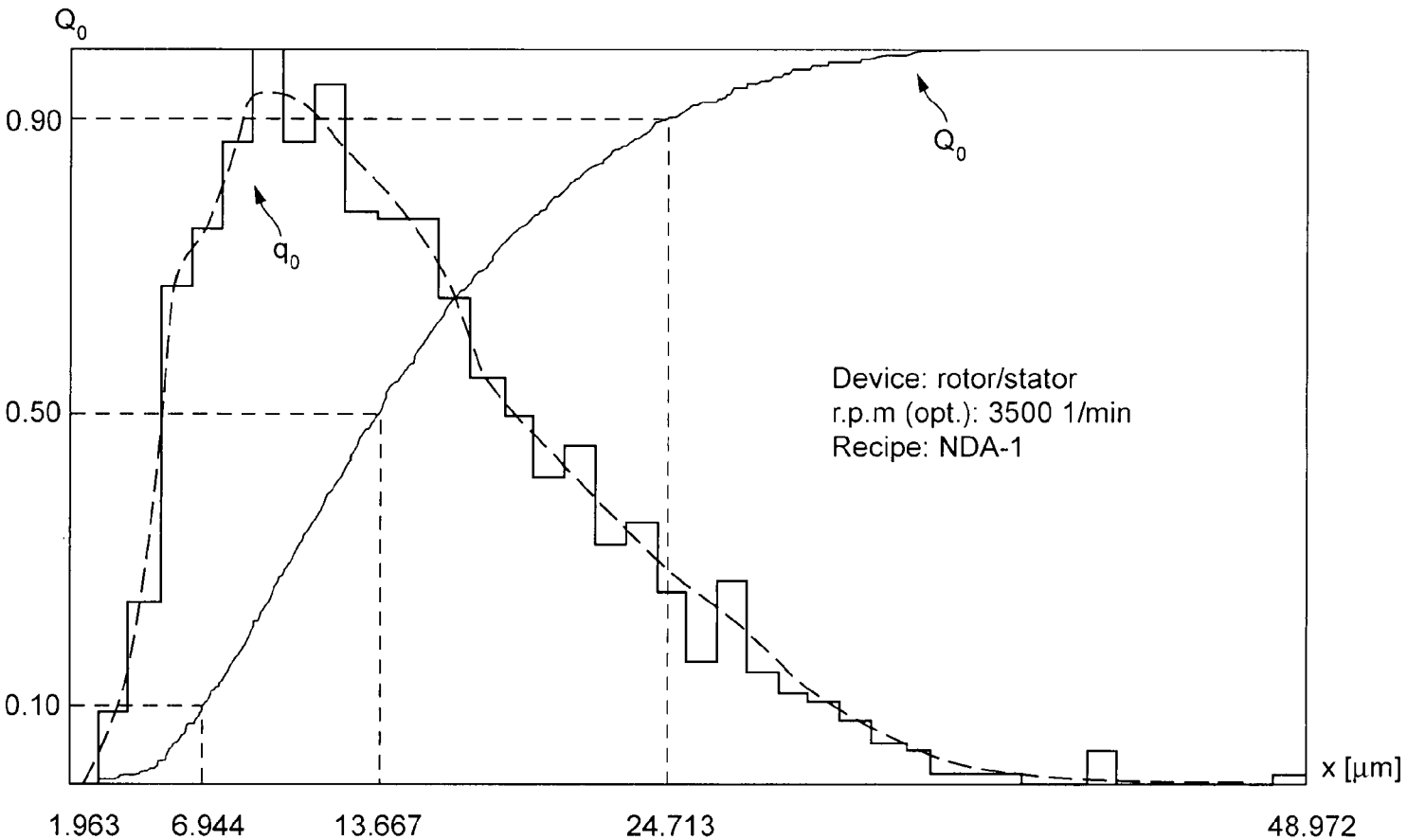
FIG. 1 is a graph of air bubble size distribution obtained from a conventional bubble dispersing device.

In the description that follows a number of useful definitions are used to define the invention and understand its novel features.

The term "heat shock" as used herein means a change in state of the foam from a solid to a liquid or semi-liquid or vice versa, caused by heating from a temperature where the matrix is frozen to a temperature where the matrix is liquid or semi-liquid, or cooling from a temperature where the matrix is liquid to a temperature where the matrix is frozen or solid.

The term "heat shock resistance" as used herein means the ability of the foam to maintain stability when subjected to one or more occurrences of heat shock. This generally means that the foam substantially retains its bubble size and bubble size distribution after experiencing heat shock, i.e., the bubbles do not coalesce and the foam structure does not deteriorate.

The present invention relates to a novel and versatile stable foam as well as to methods of making the foam and to products that incorporate or contain the novel foam. The foam is a unique arrangement of gas bubbles in a matrix, and with the addition of certain additional components results in a novel and unique lamellar cage structure that assists in stabilizing the bubbles in the foam.

The bubbles can be made of any gas depending upon the desired use of the foam. For most uses, the gas bubbles are made of air, but if desired, the gas can be any one that is inert or at least non-reactive with the liquid of the matrix and the anticipated components that are to be included in the matrix or foam. For example, nitrogen, oxygen, argon, nitrogen dioxide or mixtures thereof are generally preferred although hydrogen, helium or other such gases can be used for specialty foam applications. The fine bubbles of the foam are present in a liquid matrix that contains certain useful additives that encourage and maintain the foam structure despite exposure to different temperatures ranging from those that cause the matrix to freeze to those that heat it to just below the boiling point of the matrix.

The liquid that is used to form the matrix of the foam can also vary widely depending upon the desired type of foam and its end use. The most convenient and abundant liquid for this purpose is water, although any other liquid that is polar and non-reactive with the gas bubbles and matrix constituents may be used. As a primary use of the foam would be for consumption, the gas and liquid should be non-toxic for human consumption.

The matrix generally comprises the liquid and includes a structuring agent that forms a lamellar or vesicular cage structure without generating a gel imparting a rubbery texture to the foam. The lamellar cage structure entraps at least a substantial portion of the gas bubbles and liquid matrix therein to retain the gas bubbles and liquid in a sufficiently compact structure that substantially prevents drainage of the liquid matrix and coalescence and creaming of the gas bubbles to maintain stability of the foam even when the foam is subjected to multiple heat shock.

The term "substantially prevents drainage" as used herein means that no more than of more than 5% of the liquid drains from the foam when held for 24 hours at ambient temperature in a container. Also, the term "substantially retains stability" means that the foam can be subjected to one or more heat shock excursions without losing its structure. This means that the foam can be frozen, melted and remelted while retaining its structure. In an ice cream product, for example, which is a preferred implementation of the invention, this means that the product can be frozen and re-frozen without generating ice crystals of a size that would render the product unpalatable.

Advantageously, the liquid matrix comprises a polar fluid, the gas is nitrogen, oxygen, argon, nitrogen dioxide or mixtures thereof, the gas bubbles have a sufficiently small mean diameter and are sufficiently closely spaced in the lamellar cage structure to prevent formation of frozen crystals having mean diameters ($X_{50,0}$) of 50 microns or greater in the liquid matrix when the foam is subjected to a temperature that is below the freezing temperature of the liquid matrix. Preferably, the liquid matrix comprises water, the gas is air, the gas bubbles have a mean diameter $X_{50,0}$ that is less than 30 microns and are spaced by a distance that is less than 30 microns and the foam has a gas bubble diameter distribution ratio $X_{90,0}/X_{10,0}$ that is less than 5. More preferably, the gas bubbles have a mean diameter $X_{50,0}$ that is less than 15 microns and are spaced by a distance that is less than 15 microns and the foam has a gas bubble diameter distribution ratio $X_{90,0}/X_{10,0}$ that is less than 3.5 and more particularly is between 2 to 3.

Suitable structuring agents generally comprise an amphiphilic compound or material that includes hydrophobic and swollen hydrophilic portions that form cage structure lamellae or vesicles. The structuring agent often will be an emulsifier and be present in an amount of about 0.05 to 2.5% by weight of the liquid matrix. A preferred structuring agent comprises a thermally, physico-chemically (i.e., applying a "charge treatment" of the molecules: the net charge pronounced at neutral pH, before the heating step and neutralizing the charges at reduced pH and/or by an increased salt ion content, before whipping), or mechanically pre-treated poly glycerol ester of fatty acids ("PGE") and is present in an amount of about 0.1 to 1.5% by weight of the liquid matrix. The ester is treated to provide an improved lamellar/vesicular cage structure for retaining gas bubbles and liquid matrix therein and is particularly useful when a very fine gas bubble foam is required or desired. This can be achieved by the addition of a swelling agent, such as non-esterified fatty acids, which cause the lamellae to swell and form larger pores.

Other suitable structuring agents include stabilizing agents and conventional emulsifiers, and any one of a wide variety can be used either alone or in various combinations. The amount of the emulsifier is not critical but is generally retained at a relatively low level. PGE is preferred because it has a controllable amount of swelling and this enables one to control the formation of the cage structure to the desired level for the selected size of the bubbles and the intended use of the foam. As other emulsifiers can be adjustable (by addition of fatty acids, salt and/or the lowering of the pH) to provide different charged molecule interactions in the inter-lamella space, a number of other suitable emulsifiers, e.g., mono or triglycerides, can be selected based upon routine testing. The relative amounts can also be routinely determined, but it has been found in general that the amounts to be used will be greater than that of current food products, such as ice cream, because the emulsifier is both coating the gas bubbles as well as providing the lamellar/vesicular structure of the cage.

The liquid matrix may include a viscosity increasing agent to provide a viscosity sufficient to remain between the bubbles in the foam. This component can be any one of a number of viscosity increasing agents that are known for use with the particular liquid selected for the foam. When the matrix liquid is water, the skilled artisan has numerous compounds to consider for selection. The viscosity increasing agent may be a carbohydrate in an amount of about 5 to 45% by weight of the liquid matrix, a plant or dairy protein in an amount about 5 to 20% by weight of the liquid matrix, a polysaccharide in an amount of about 0.1 to 2% by weight of the liquid matrix, or a mixture thereof. More specifically, the carbohydrate, if present can be sucrose, glucose, fructose, corn syrup, lactose, maltose, or galaxies and is present in an amount of about 20 to 35% by weight of the liquid matrix, the plant or dairy protein, if present, can be soy, whey or milk protein in an amount about 10 to 15% by weight of the liquid matrix, and the polysaccharide, if present, can be a stabilizer such as a galactomannan or guar gum, locust bean gum, carrageenan gum or xanthan gum in an amount of about 0.2 to 1.25% by weight of the liquid matrix. Other materials can be used for this purpose as will be referred to herein. The combination of an emulsifier and a stabilizing agent is preferred in certain embodiments.

Another embodiment of the invention relates to solid foams of the types that are described herein and that are maintained at a temperature that is below that which causes the liquid matrix to solidify or freeze. Surprisingly, the foam has a sufficiently small bubble size and size distribution such that the solidified or frozen matrix does not include frozen crystals from the liquid that have mean diameters ($X_{50,0}$) of 50 microns or greater, and furthermore the foam remains stable after multiple heat shocks.

Another embodiment of the invention relates to method of making a stable foam comprising gas, a liquid matrix, gas bubbles and a structuring agent forming a lamellar or vesicular cage structure that entraps at least a substantial portion of the gas bubbles and liquid matrix therein. This method generally includes the steps of providing a crystalline amphiphilic agent compound or material that includes hydrophobic and hydrophilic portions in a liquid matrix at a pH of between 6 and 8; adding a swelling agent to the liquid matrix with heating for a time and at a temperature sufficient to melt the crystalline compound or material and provide a solution of the liquid matrix, the swelling agent and hydrophobic and swollen hydrophilic portions of the amphiphilic agent that form cage structure lamellae or vesicles; homogenizing the solution under conditions sufficient to disperse the cage structure lamellae/vesicles; cooling the homogenized solution to a temperature below ambient to fix the lamellae/vesicles in the cage structure without generating a gel imparting a rubbery texture; and providing air bubbles in the solution. Thus, the lamellar cage structure entraps at least a substantial portion of the gas bubbles and liquid matrix therein to retain the gas bubbles and liquid in a sufficiently compact structure that substantially prevents drainage of the liquid matrix and coalescence and creaming of the gas bubbles to prepare a stable foam that maintains stability even when subjected to multiple heat shock.

The pH of the deionized liquid matrix is preferably adjusted to neutral (approximately 7) prior to the addition of the amphiphilic agent, and then the solution is heated to a temperature of above 65° C. to 95° C. for a time of about 20 to 85 seconds. This helps dissolve the amphiphilic agent into the liquid matrix. In case of combining a pasteurization step the holding time at the respective temperature is adequately adjusted between about 25 minutes at 65° C. to 30 seconds at 85° C. The amphiphilic agent generally comprises a surfactant or more specifically an emulsifier and is present in an amount of about 0.1 to 2% by weight of the liquid matrix, and the swelling agent typically is a material that is compatible with the amphiphilic agent and which causes the agent to swell. For the exemplary PGE (poly glycerol ester of fatty acids) emulsifier, the swelling agent comprises unesterified fatty acids that are soluble or dispersible in the liquid matrix and that is also added in an amount of between about 0.1 and 2% by weight of the liquid matrix. At a pH of 7 the majority of fatty acids are unprotonated and carry a net charge supporting the swelling effect.

The homogenization may be a high pressure homogenization conducted at 125 to 225 bars at a temperatures of about 60° C. to 95° C. and then the homogenized solution is cooled to a temperature of less than about 10° C. but without freezing the liquid matrix for a period of between 4 and 20 hours. Thereafter, the cooled solution may be further treated to reduce pH to between 2 and 4.5 and/or to add a salt prior to aerating the cooled solution to form the foam.

The liquid matrix generally comprises a polar fluid free from salt ions and optionally includes a viscosity increasing agent in an amount sufficient to provide the liquid matrix with an increased viscosity to help retain the liquid matrix and gas bubbles in the lamellar cage structure. One liquid matrix comprises deionized water, and the viscosity modifying agent may be any of those mentioned more specifically herein. The viscosity modifying agent is generally added to the deionized water at a neutral pH and with moderate heating to a temperature of about 30° C. to 50° C. prior to adding the amphiphilic material or compound.

The gas bubbles are generally nitrogen, oxygen, argon, nitrogen dioxide or mixtures thereof and are provided in the solution by a whipping device or by introduction through a porous membrane. To obtain gas bubbles having a mean gas bubble diameter $X_{50,0}$ that is below 10 microns and a narrow gas bubble size distribution with a bubble diameter distribution ratio $X_{90,0}/X_{10,0}$ that is less than 3.5, the gas bubbles can be provided in the solution through a rotating membrane of 6 micrometer mean pore diameter that is configured, dimensioned, positioned and moved to detach gas bubbles of that size from the membrane surface where they are formed from a gas flow that passes through the membrane, and entrain them in the liquid matrix. Finally, the process results in gas bubbles having a mean gas bubble diameter $X_{50,0}$ that is below 7.5 microns, and a narrow gas bubble size distribution with a bubble diameter distribution ratio $X_{90,0}/X_{10,0}$ that is less than 3.5. These gas bubbles can be provided in the solution through a membrane of 6 micrometer mean pore diameter that is configured in the shape of a closed cylinder that is stationary with gas introduced from the exterior into the cylinder to form gas bubbles on the interior surface of the membrane, and the liquid matrix flowing past the interior membrane surface eventually supported by a rotating non-membrane cylinder placed concentrically or eccentrically within the membrane cylinder, to detach the gas bubbles.

As noted above, a preferred product is a solid foam, and this can be provided by solidifying the liquid matrix by maintaining it at a temperature that is below that which causes the liquid matrix to solidify or freeze. Surprisingly, the solidified or frozen matrix does not include compact frozen crystals from the liquid that have mean diameters $X_{50,0}$ of 50 microns or greater, and further wherein the foam remains stable without significant changes in the gas bubble and ice crystal size distributions after multiple heat shocks. This can be obtained whether a viscosity increasing agent is added to the deionized liquid matrix or not although a viscosity increasing agent is preferred for other reasons that will become apparent in the following detailed description.

A preferred viscosity increasing agent is a sugar, since one of the primary uses for the foam of the invention is in a food or pharmaceutical product for consumption. In addition to increasing the viscosity of the matrix, sugar imparts a pleasing and desirable taste to the foam. Any conventional sugar component can be used as there is no criticality to the specific type. When a polysaccharide is used, a gum is preferred. Suitable gums include guar gum, locus bean gum, xanthan gum, pectin or carrageenan.

It has been found that the microstructure of the foam includes a lamellar or vesicular "cage" or "cell" structure formed by the emulsifier and in which the bubbles are entrapped. The cage is sufficiently versatile to retain its orientation and structure despite heating and cooling of the matrix. Furthermore, this cage structure is not directly dependent upon the viscosity of the matrix so that the skilled artisan is provided with a number of options in the design of the foam for the particular end use.

One embodiment relates to the production of stable nanofoams which are of low cost and of great utility for a number of different food products. When frozen, such foams hinder the generation and growth of ice crystals. Such foams are low cost due to the small number of conventional ingredients. If desired, such foams can be allergen-free (i.e., containing no protein or dairy components) or/and can have a low caloric content with little or no fat. The foams also provide a smooth, creamy mouthfeel with a desirable flavor release.

These foams are relatively easy to manufacture and are shelf stable at room temperature. They have a clean melting behavior with a clean and fresh flavor release. There is a low hygiene risk due to the omission of dairy ingredients.

A key feature of the present foam is its ability to retain very small, homogenous, micron- to nanosized bubbles that act as ball bearings in the consumer's mouth to provide smoothness and lubrication resulting in a very creamy mouthfeel despite the absence of fat. This opens a whole new frontier of "healthy diet" products heretofore not possible of manufacture.

The structuring agent may be present in the foam alone or in combination with a stabilizer. Gum stabilizers are particularly effective with emulsifiers in controlling viscosity, providing mouth feel and improving whipping (aerating) properties; to provide a protective colloid to stabilize proteins to heat processing; to modify the surface chemistry of fat surfaces to minimize creaming; to provide acid stability to protein systems and; to increase freeze-thaw stability. Gums can be classified as neutral and acidic, straight- and branched-chain, gelling and non-gelling. The principal gums that may be used are Karaya gums, locust bean gum, carrageenan, xanthan, guar, pectin, tara gum and carboxymethyl cellulose.

Generally the foam compositions of the invention can be used to make a number of different edible and non-edible products. When made into a foodstuff or beverage composition, the foam can be naturally sweetened. Natural sources of sweetness include sucrose (liquid or solids), glucose, fructose, and corn syrup (liquid or solids). Other sweeteners include lactose, maltose, and galactose. Levels of sugars and sugar sources preferably result in sugar solids levels of up to 20% by weight, preferably from 5 to 18% by weight, especially from 10 to 17% by weight.

If it is desired to use artificial sweeteners, any of the artificial sweeteners well known in the art may be used, such as aspartame, saccharine, Alitame® (obtainable from Pfizer), acesulfame K (obtainable from Hoechst), cyclamates, neotame, sucralose and the like. When used, aspartame is preferred.

If desired, glycerol or also anti-freeze proteins may be used to control ice formation in foams having a larger bubble size and bubble size distribution. Sorbitol may also be employed but glycerol is preferred. The glycerol may be used in an amount of about 1% to 5%, preferably 2.5% to 4.0%. Anti Freeze Proteins (AFP) may be used in ppm concentrations. These components are not needed when the preferred fine bubble sizes (or nanobubble sizes) are included in the foam.

Flavorings are preferably added to the product but only in amounts that will impart a mild, pleasant flavor. The flavoring may be any of the commercial flavors employed in ice cream, such as varying types of cocoa, pure vanilla or artificial flavor, such as vanillin, ethyl vanillin, chocolate, extracts, spices and the like. It will further be appreciated that many flavor variations may be obtained by combinations of the basic flavors. The confection compositions are flavored to taste as mentioned above. Suitable flavorants may also include seasoning, such as salt, and imitation fruit or chocolate flavors either singly or in any suitable combination, whereas in the case of salt additions they have to be added after the heating and subsequent cooling, but before foaming. Flavorings which mask off-tastes from vitamins, minerals and other ingredients may also included in the foam products of the invention. Malt powder can also be used to impart flavor.

Preservatives such as Polysorbate 80, Polysorbate 65 and potassium sorbate may be used as desired. Calcium is preferably present in the composition at from 10 to 30% RDI, especially about 25% RDI. The calcium source is preferably tricalcium phosphate. For example % by weight levels of tricalcium phosphate may range from 0.5 to 1.5%. In a preferred embodiment, the product is fortified with one or more vitamins and/or minerals and/or fiber sources, in addition to the tricalcium phosphate source of calcium. These may include any or all of the following: Ascorbic acid (Vitamin C), Tocopherol Acetate (Vitamin E), Biotin (Vitamin H), Vitamin A Palmitate, Niacinamide (Vitamin B3), Potassium Iodide, d-Calcium Pantothenate (Vitamin B5), Cyanocobalamin (Vitamin B12), Riboflavin (Vitamin B2), Thiamine Mononitrate (Vitamin B1), Molybdenum, Chromium, Selenium, Calcium Carbonate, Calcium Lactate, Manganese (as Manganese Sulfate), Iron (as Ferric Orthophosphate) and Zinc (as Zinc Oxide). The vitamins are preferably present at from 5 to 20% RDI, especially from about 15% RDI. Preferably, fiber sources are present in the product at greater than 0.5% by weight and do not exceed 6% by weight, especially 5% by weight.

Some of the vitamins and/or minerals can be added to the frozen confection mix whereas others can be included in the ingredients for adjuncts such as wafers, variegates and sauces.

The foam compositions of the invention can also contain a functional ingredient. The term "functional ingredient," as used herein, includes physiologically or pharmacologically active substances intended for use in the treatment, prevention, diagnosis, cure or mitigation of disease or illness, or substances that provide some degree of nutritional or therapeutic benefit to an animal when consumed. The term "functional ingredient" refers more particularly to the ISLI European definition that states that a functional food can be regarded as "functional" if it is satisfactorily demonstrated to affect beneficially one or more target functions in the body, beyond adequate nutritional effects in a way that is either an improved state of health and well-being and/or reduction of risk of disease (Scientific Concept of Functional Foods in Europe: Consensus Document, British Journal of Nutrition, Volume 80, supplement 1, August 1998). Non-limiting examples include drugs, botanical extracts, enzymes, hormones, proteins, polypeptides, antigens, nutritional supplements such as fatty acids, antioxidants, vitamins, minerals, as well as other pharmaceutically or therapeutically useful compounds. The functional ingredients may include ingredients having active effects in dental or medical hygiene, bone health, digestive aid, intestinal protection, general nutrition, stress relief, etc.

Another preferred component of the foam composition of the invention is a nutritive component. The term "nutritive component" as used herein refers to a substance that exerts a physiological effect on an animal or mammal. Typically, nutritive components fulfill a specific physiological function or promote the health and well-being of the consumer. Specific nutritive components include a botanical extract, vitamins, minerals, bulking agents or other nutrition supplying components.

The terms "botanical extract" and "botanical," as used interchangeably herein, refer to a substance derived from a plant source. Non-limiting examples may include echinacea, Siberian ginseng, ginko biloba, kola nut, goldenseal, golo kola, schizandra, elderberry, St. Johns Wort, valerian and ephedra.

This additive may be a probiotic bacteria as that has been used for treating immune conditions, as well as for preventing or inhibiting diarrhea brought about by pathogenic bacteria.

The nutritive component may be one or more nutrients or minerals selected from the group consisting of vitamin E, vitamin C, vitamin B6, folic acid, vitamin B12, copper, zinc, selenium, calcium, phosphorus, magnesium, iron, vitamin A, vitamin B1, vitamin B2, niacin and vitamin D. Any one or all of these minerals or nutrients can be included.

The food product of the invention may include polydextrose or fructose oligosaccharides such as inulin as a bulking agent or a fiber source and is preferably included at from 1 to 10% by weight, especially from 1 to 6% by weight.

The term "medicinal component," as used herein refers to a pharmacologically active substance that exerts a localized or systemic effect or effects on an animal or mammal.

The medicinal component can be any type of biologically active agent that does not react with or otherwise deteriorate the foam. A simple contact test can conducted to determine compatibility. The agent will depend upon whether the delivery system is intended for ingestion, topical application or implantation, such as by injection or as a suppository. Active agents that are found to not be compatible with the foam can be coated or encapsulated of otherwise treated to prevent the active agent from directly contacting the foam at least until after the delivery system is applied to or administered to the subject.

The cosmetic component can be any active ingredient or combination of ingredients that is applied in a topical manner to the skin or mucous membrane of an animal or mammal to administer a medicinal component or to provide a benefit or improvement to a benefit to the animal or mammal.

The aroma component can be any type of flavor- or taste-enhancing component or any type of component that imparts a perceivable odor character to the delivery system.

The term "specific functionality" when used to describe a component means that the component possesses some feature, property or function that is not otherwise provided by the foam itself. One such component is a pigment or other coloration adding component. For example, when the foam is to be consumed, a specific functionality could be a flavor, edible inclusion, or other organoleptic enhancing item. For pharmaceutical delivery systems, the specific functionality could be a material that causes the delayed or sustained release of the active additive. When the foam is intended for non-consumption uses, the specific functionality could be a compound that imparts flame resistance. The skilled artisan can select the components that provide the desired functionality for any particular delivery system based on the additive to be delivered.

The additive may also be a biopolymer or bioengineered composition such as those that provide a sustained or delayed release of a medicinal or nutritive components. Preferably, this additive is one that biologically degrades in the body, e.g., a PLGA polymer.

The additive may also be an inorganic component that is delivered by the system and that imparts sound dampening properties. Typical inorganic components include glass, clay or ceramic particles or fibers and these are added in the appropriate amounts to achieve the desired insulating or acoustic dampening effect. The delivery system is generally prepared at a viscosity that facilitates pumping or fluid flow, or it can be heated to be flowable but then capable of solidifying or freezing after being placed.

The form of the additive is not critical to the invention. Although a gaseous additive can be used, it should be dissolvable in the liquid matrix or capable of being incorporated in the gas of the bubbles. The additive preferably is in a solid or liquid form. Generally, the additive is a liquid droplet that can be mixed with the liquid matrix. Liposomes, emulsion components or other micelles can be used if desired, with the liquid matrix representing the continuous phase. Alternatively, the additive can be a particle, i.e., a solid material or a composite material of a solid or liquid that is encapsulated with a solid or semi-solid coating. These droplets or particles can be soluble so that they dissolve fully or partially into the liquid matrix, or they can be insoluble and suspended in the matrix before or after forming the foam. Preferably, the additive is present with the liquid or gas and is incorporated into the delivery system prior to formation of the foam.

The foams of the invention can also be used as a delivery system for beverage composition. As used herein, the term "beverage composition" denotes a composition that is single-strength and ready to drink, that is, drinkable.

Depending upon their formulation, the food or beverage products of the invention can be formulated to provide an onset and maintenance of energy and mental alertness as well as nutrition to the consumer. Optionally and preferably, the compositions further provide satiation and/or refreshment. The present compositions, which comprise the foam and a mixture of one or more carbohydrates, one milk protein, one natural caffeine source, a vitamin premix, and, optionally, a flavorant, a coloring agent and an antioxidant, surprisingly provide such onset and maintenance of energy and mental alertness.

The carbohydrates can be a mixture of one or more monosaccharides or disaccharides, and preferably in combination with one or more complex carbohydrates. In selecting effective carbohydrates and carbohydrate levels for use in the present compositions, it is important that the carbohydrates and levels thereof which are chosen allow a sufficient rate of digestion and intestinal absorption to provide a steady maintenance of glucose, which in turn provides energy and alertness to the consumer.

It has been discovered that the monosaccharides and disaccharides provide immediate energy to the consumer while the complex carbohydrate components, are hydrolyzed in the digestive tract to provide a later, or delayed and maintained, onset of energy for the consumer. As is also set forth herein, the inclusion of one or more stimulants and/or plant phytochemical constituents enhances this internal response. Accordingly, as will be discussed more particularly herein, it is particularly preferred that one or more stimulants and/or plant phytochemical constituents are provided to the composition for optimization of the maintenance of energy and mental alertness.

Non-limiting examples of monosaccharides which may be utilized herein include sorbitol, mannitol, erythrose, threose, ribose, arabinose, xylose, xylitol, ribulose, glucose, galactose, mannose, fructose, and sorbose. Preferred monosaccharides for use herein include glucose and fructose, most preferably glucose. Disaccharides can be used as the source of immediate energy. Non-limiting examples of disaccharides which may be utilized herein include sucrose, maltose, lactitol, maltitol, maltulose, and lactose. These can be added if not already present in the foam matrix for providing taste or energy.

The complex carbohydrate utilized herein is an oligosaccharide, polysaccharide, and/or carbohydrate derivative, preferably an oligosaccharide and/or polysaccharide. As used herein, the term "oligosaccharide" means a digestible linear molecule having from 3 to 9 monosaccharide units, wherein the units are covalently connected via glycosidic bonds. As used herein, the term "polysaccharide" means a digestible (i.e., capable of metabolism by the human body) macromolecule having greater than 9 monosaccharide units, wherein the units are covalently connected via glycosidic bonds. The polysaccharides may be linear chains or branched. Preferably, the polysaccharide has from 9 to about 20 monosaccharide units. Carbohydrate derivatives, such as a polyhydric alcohol (e.g., glycerol), may also be utilized as a complex carbohydrate herein. As used herein, the term "digestible" means capable of metabolism by enzymes produced by the human body.

Examples of preferred complex carbohydrates include raffinoses, stachyoses, maltotrioses, maltotetraoses, glycogens, amyloses, amylopectins, polydextroses, and maltodextrins. The most preferred complex carbohydrates are maltodextrins.

Maltodextrins are a form of complex carbohydrate molecule which is several glucose units in length. The maltodextrins are hydrolyzed into glucose in the digestive tract where they provide an extended source of glucose. Maltodextrins may be spray-dried carbohydrate ingredients made by controlled hydrolysis of corn starch.

The protein source may be selected from a variety of materials, including without limitation, milk protein, whey protein, caseinate, soy protein, egg whites, gelatins, collagen, protein hydrolysates and combinations thereof. Included in the protein source are lactose-free skim milk, milk protein isolate, and whey protein isolate. It is also contemplated to use soy milk with the present compositions. As used herein, soy milk refers to a liquid made by grinding dehulled soy beans, mixing with water, cooking and recovering the dissolved soy milk out of the beans.

When desired, the foam products of the present invention may further comprise a stimulant to provide mental alertness. The inclusion of one or more stimulants serves to provide further maintenance of energy to the user by delaying the glycemic response associated with ingestion of the composition, by causing metabolic alteration of glucose utilization, by directly stimulating the brain by translocation across the blood brain barrier or by other mechanisms. Because one or more stimulants will contribute to the onset, and particularly maintenance of energy wherein the composition is ingested, it is a particularly preferred embodiment of the present invention to include one or more stimulants.

As is commonly known in the art, stimulants can be obtained by extraction from a natural source or can be synthetically produced. Non-limiting examples of stimulants include methylxanthines, e.g., caffeine, theobromine, and theophylline. Additionally, numerous other xanthine derivatives have been isolated or synthesized, which may be utilized as a stimulant in the compositions herein. See e.g., Bruns, Biochemical Pharmacology, Vol. 30, pp. 325-333 (1981). It is preferred that the natural sources of these materials be used.

Preferably, one or more of these stimulants are provided by coffee, tea, kola nut, cacao pod, Yerba Mate', yaupon, guarana paste, and yoco. Natural plant extracts are the most preferred sources of stimulants as they may contain other compounds that delay the bioavailability of the stimulant thus they may provide mental refreshment and alertness without tension or nervousness.

The most preferred methylxanthine is caffeine. Caffeine may be obtained from the aforementioned plants and their waste or, alternatively, may be synthetically prepared. Preferred botanical sources of caffeine which may be utilized as a complete or partial source of caffeine include green tea extract, guarana, Yerba Mate' extract, black tea, cola nuts, cocoa, and coffee. As used herein, green tea extract, guarana, coffee, and Yerba Mate' extract are the most preferred botanical sources of caffeine, most preferably green tea extract and Yerba Mate' extract. Besides serving as a source of caffeine, green tea extract has the additional advantage of being a flavanol as will be discussed later. Yerba Mate' extract may have the additional benefit of an appetite suppressing effect and may be included for this purpose as well.

The green tea extract can be obtained from the extraction of unfermented teas, fermented teas, partially fermented teas, and mixtures thereof. Preferably, the tea extracts are obtained from the extraction of unfermented and partially fermented teas. The most preferred tea extracts are obtained from green tea. Both hot and cold extracts can be used in the present invention. Suitable methods for obtaining tea extracts are well known. See e.g., Ekanavake, U.S. Pat. No. 5,879,733; Tsai, U.S. Pat. No. 4,935,256; Lunder, U.S. Pat. No. 4,680,193; and Creswick U.S. Pat. No. 4,668,525.

Preferably, green tea extract and Yerba Mate' extract are present in relatively small amounts of between about 0.1 and about 0.4% and between about 0.1 and about 0.5%, respectively. More preferably, they are present in the amounts of between about 0.15 and about 0.35 percent, and between about 0.15 and 0.25%, respectively. While the greater amounts provide greater stimulation, they also provide a less desirable taste to the beverage. This can be compensated for by the addition of the higher amounts of carbohydrate or by the addition of an artificial sweetener so that the final taste of the beverage is palatable.

Instead of being formulated as a beverage or food composition per se, the foam of the invention can also be added as a topping or creamer to a heated beverage such as coffee or tea. Any of these compositions, as noted above, may further comprise vitamins or minerals. At least three, and preferably more, vitamins can be provided by a vitamin premix. The U.S. Recommended Daily Intake (USRDI) for vitamins and minerals are defined and set forth in the Recommended Daily Dietary Allowance-Food and Nutrition Board, National Academy of Sciences-National Research Council. Various combinations of these vitamins and minerals can be used.

Non-limiting examples of such vitamins, include choline bitartate, niacinamide, thiamin, folic acid, d-calcium pantothenate, biotin, vitamin A, vitamin C, vitamin $B_1$ hydrochloride, vitamin $B_2$, vitamin $B_3$, vitamin $B_6$ hydrochloride, vitamin $B_{12}$, vitamin D, vitamin E acetate, vitamin K. Preferably, at least three vitamins are selected from choline bitartate, niacinamide, thiamin, folic acid, d-calcium pantothenate, biotin, vitamin A, vitamin C, vitamin $B_1$ hydrochloride, vitamin $B_2$, vitamin $B_3$, vitamin $B_6$ hydrochloride, vitamin $B_{12}$, vitamin D, vitamin E acetate, vitamin K. More preferably, the composition comprises vitamin C and two or more other vitamins selected from choline bitartate, niacinamide, thiamin, folic acid, d-calcium pantothenate, biotin, vitamin A, vitamin $B_1$ hydrochloride, vitamin $B_2$, vitamin $B_3$, vitamin $B_6$ hydrochloride, vitamin $B_{12}$, vitamin D, vitamin E acetate, vitamin K. In an especially preferred embodiment of the present invention, a composition comprises vitamin choline bitartate, niacinamide, folic acid, d-calcium panothenate, vitamin A, vitamin $B_1$ hydrochloride, vitamin $B_2$, vitamin $B_6$ hydrochloride, vitamin $B_{12}$, vitamin C, vitamin E acetate. Wherein the product comprises one of these vitamins, the product preferably comprises at least 5%, preferably at least 25%, and most preferably at least 35% of the USRDI for such vitamin.

Commercially available vitamin A sources may also be included in the present compositions. As used herein, "vitamin A" includes, but is not limited to, vitamin A (retinol), beta-carotene, retinol palmitate, and retinol acetate. Vitamin A sources include other pro-vitamin A carotenoids such as those found in natural extracts that are high in carotenoids with provitamin A activity. Beta-carotene can also serve as a coloring agent as will be discussed later. Commercially available sources of vitamin $B_2$ (also known as riboflavin) may be utilized in the present compositions. Commercially available sources of vitamin C can be used herein. Encapsulated ascorbic acid and edible salts of ascorbic acid can also be used.

Nutritionally supplemental amounts of other vitamins which may be incorporated herein include, but are not limited to, choline bitartate, niacinamide, thiamin, folic acid, d-calcium pantothenate, biotin, vitamin $B_1$ hydrochloride, vitamin $B_3$, vitamin $B_6$ hydrochloride, vitamin $B_{12}$, vitamin D, vitamin E acetate, vitamin K.

The foam compositions of the present invention may further comprise additional optional components to enhance, for example, their performance in providing energy, mental alertness, organoleptic properties, and nutritional profile. For example, one or more, flavanols, acidulants, coloring agents, minerals, soluble fibers, non-caloric sweeteners, flavoring agents, preservatives, emulsifiers, oils, carbonation components, and the like may be included in the compositions herein. Such optional components may be dispersed, solubilized, or otherwise mixed into the present compositions. These components may be added to the compositions herein provided they do not substantially hinder the properties of the beverage composition, particularly the provision of energy and mental alertness. Non-limiting examples of optional components suitable for use herein are given below.

If desired, one or more botanicals or plant phytochemical constituents can be added. This would include flavanols or other phytochemicals which are in essence "healthy." The inclusion of one or more flavanols serves to delay the glycemic response associated with ingestion of the present compositions, thus providing further maintenance of energy to the user. Because one or more flavanols will contribute to the onset, and particularly maintenance of energy wherein the composition is ingested, it is particularly preferred that one or more flavanols be included.

Flavanols are natural substances present in a variety of plants (e.g., fruits, vegetables, and flowers). The flavanols which may be utilized in the present invention can be extracted from, for example, fruit, vegetables, or other natural sources by any suitable method well known to those skilled in the art. For example, flavanols may be extracted from either a single plant or mixtures of plants. Many fruits, vegetables, flowers and other plants containing flavanols are known to those skilled in the art. Alternatively, these flavanols may be prepared by synthetic or other appropriate chemical methods and incorporated into the present compositions. Flavanols, including catechin, epicatechin, and their derivatives are commercially available.

The present compositions may optionally but preferably further comprise one or more acidulants. An amount of an acidulant may be used to maintain the pH of the composition. Compositions of the present invention preferably have a pH of from about 2 to about 8, more preferably from about 2 to about 5, even more preferably from about 2 to about 4.5, and most preferably from about 2.7 to about 4.2. Beverage of foodstuff acidity can be adjusted to and maintained within the requisite range by known and conventional methods, e.g., the use of one or more acidulants. Typically, acidity within the above recited ranges is a balance between maximum acidity for microbial inhibition and optimum acidity for the desired beverage flavor.

Organic as well as inorganic edible acids may be used to adjust the pH of the beverage. The acids can be present in their undissociated form or, alternatively, as their respective salts, for example, potassium or sodium hydrogen phosphate, potassium or sodium dihydrogen phosphate salts. The preferred acids are edible organic acids which include citric acid, phosphoric acid, malic acid, fumaric acid, adipic acid, gluconic acid, tartaric acid, ascorbic acid, acetic acid, phosphoric acid or mixtures thereof.

The acidulant can also serve as an antioxidant to stabilize beverage components. Examples of commonly used antioxidants include but are not limited to ascorbic acid, EDTA (ethylenediaminetetraacetic acid), and salts thereof.

Small amounts of one or more coloring agents may be utilized in the compositions of the present invention. Beta-carotene is preferably used. Riboflavin and FD&C dyes (e.g., yellow #5, blue #2, red #40) and/or FD&C lakes may also be used. By adding the lakes to the other powdered ingredients, all the particles, in particular the colored iron compound, are completely and uniformly colored and a uniformly colored beverage mix is attained. Additionally, a mixture of FD&C dyes or a FD&C lake dye in combination with other conventional food and food colorants may be used. Additionally, other natural coloring agents may be utilized including, for example, chlorophylls and chlorophyllins, as well as fruit, vegetable, and/or plant extracts such as grape, black currant, aronia, carrot, beetroot, red cabbage, and hibiscus. Natural colorants are preferred for "all natural" products.

The amount of coloring agent used will vary, depending on the agents used and the color intensity desired in the finished product. The amount can be readily determined by one skilled in the art. Generally, if utilized, the coloring agent should be present at a level of from about 0.0001% to about 0.5%, preferably from about 0.001% to about 0.1%, and most preferably from about 0.004% to about 0.1%, by weight of the composition.

The compositions herein may be fortified with one or more minerals. The U.S. Recommended Daily Intake (USRDI) for minerals are defined and set forth in the Recommended Daily Dietary Allowance-Food and Nutrition Board, National Academy of Sciences-National Research Council.

Unless otherwise specified herein, wherein a given mineral is present in the composition, the composition typically comprises at least about 1%, preferably at least about 5%, more preferably from about 10% to about 200%, even more preferably from about 40% to about 150%, and most preferably from about 60% to about 125% of the USRDI of such mineral. Unless otherwise specified herein, wherein a given mineral is present in the composition, the composition comprises at least about 1%, preferably at least about 5%, more preferably from about 10% to about 200%, even more preferably from about 20% to about 150%, and most preferably from about 25% to about 120% of the USRDI of such vitamin.

Minerals which may optionally be included in the compositions herein are, for example, calcium, potassium, magnesium, zinc, iodine, iron, and copper. Any soluble salt of these minerals suitable for inclusion in edible compositions can be used, for example, magnesium citrate, magnesium gluconate, magnesium sulfate, zinc chloride, zinc sulfate, potassium iodide, copper sulfate, copper gluconate, and copper citrate.

Calcium is a particularly preferred mineral for use in the present invention. Preferred sources of calcium include, for example, calcium-citrate-lactate, amino acid chelated calcium, calcium carbonate, calcium oxide, calcium hydroxide, calcium sulfate, calcium chloride, calcium phosphate, calcium hydrogen phosphate, calcium dihydrogen phosphate, calcium citrate, calcium malate, calcium titrate, calcium gluconate, calcium realate, calcium tartrate, and calcium lactate, and in particular calcium citrate-malate. The form of calcium citrate-malate is described in, e.g., Mehansho et al., U.S. Pat. No. 5,670,344; or Diehl et al., U.S. Pat. No. 5,612,026. Preferred compositions of the present invention will comprise from about 0.01% to about 0.5%, more preferably from about 0.03% to about 0.2%, even more preferably from about 0.05% to about 0.15%, and most preferably from about 0.1% to about 0.15% of calcium, by weight of the product.

Iron may also be utilized in the compositions and methods of the present invention. Acceptable forms of iron are well-known in the art. The amount of iron compound incorporated into the product will vary widely depending upon the level of supplementation desired in the final product and the targeted consumer. Iron fortified compositions of the present invention typically contain from about 5% to about 100%, preferably from about 15% to about 50%, and most preferably about 20% to about 40% of the USRDI for iron.

One or more soluble fibers may also optionally be included in the compositions of the present invention to provide, for example, satiation and refreshment, and/or nutritive benefits. Soluble dietary fibers are a form of carbohydrates which cannot be metabolized by the enzyme system produced by the human body and which pass through the small intestine without being hydrolyzed (and, thus, are not included within the definition of complex carbohydrate herein). Without intending to be limited by theory, since soluble dietary fibers swell in the stomach, they slow down gastric emptying thus prolonging the retention of nutrients in the intestine which results in a feeling of satiation.

Soluble fibers which can be used singularly or in combination in the present invention include but are not limited to pectins, psyllium, guar gum, xanthan gum, alginates, gum arabic, inulin, agar, and carrageenan. Preferred among these soluble fibers are at least one of guar gum, xanthan, and carrageenan, most preferably guar gum or xanthan gum. These soluble fibers may also serve as stabilizing agents in this invention.

Particularly preferred soluble fibers for use herein are glucose polymers, preferably those which have branched chains. Preferred among these soluble fibers is one marketed under the trade name Fiβersol2, commercially available from Matsutani Chemical Industry Co., Itami City, Hyogo, Japan.

Pectins are preferred soluble fibers herein. Even more preferably, low methoxy pectins are used. The preferred pectins have a degree of esterification higher than about 65%, and are obtained by hot acidic extraction from citrus peels and may be obtained, for example, from Danisco Co., Braband, Denmark.

The foam products of the present invention, when intended for consumption, are provided with the appropriate blend of flavorants and sweeteners so that they are sweet enough to wash the strong flavors of the other components due to the presence of the aforementioned carbohydrate sources. In addition, effective levels of non-caloric sweeteners may also optionally be used in the present invention to enhance the organoleptic and sweetness quality of the compositions, but not as a replacement of the carbohydrate source. Non-limiting examples of non-caloric sweeteners include aspartame, saccharine, cyclamates, acesulfame K, L-aspartyl-L-phenylalanine lower alkyl ester sweeteners, L-aspartyl-D-alanine amides, L-aspartyl-D-serine amides, L-aspartyl-hydroxymethyl alkane amide sweeteners, L-aspartyl-1-hydroxyethylalkane amide sweeteners, glycyrrhizins, and synthetic alkoxy aromatics. Aspartame and acesulfame-K are the most preferred non-caloric sweeteners utilized herein, and may be utilized alone or in combination.

One or more flavoring agents are recommended for the present invention in order to enhance their palatability. Any natural or synthetic flavor agent can be used in the present invention. For example, one or more botanical and/or fruit flavors may be utilized herein. As used herein, such flavors may be synthetic or natural flavors.

Particularly preferred fruit flavors are exotic and lactonic flavors such as, for example, passion fruit flavors, mango flavors, pineapple flavors, cupuacu flavors, guava flavors, cocoa flavors, papaya flavors, peach flavors, and apricot flavors. Besides these flavors, a variety of other fruit flavors can be utilized such as, for example, apple flavors, citrus flavors, grape flavors, raspberry flavors, cranberry flavors, cherry flavors, and the like. These fruit flavors can be derived from natural sources such as fruit juices and flavor oils, or may alternatively be synthetically prepared. The natural flavorants are preferred for "all natural" drinks.

Preferred botanical flavors include, for example, aloe vera, guarana, ginseng, ginkgo, hawthorn, hibiscus, rose hips, chamomile, peppermint, fennel, ginger, licorice, lotus seed, schizandra, saw palmetto, sarsaparilla, safflower, St. John's Wort, curcuma, cardimom, nutmeg, cassia bark, buchu, cinnamon, jasmine, haw, chrysanthemum, water chestnut, sugar cane, lychee, bamboo shoots, vanilla, coffee, and the like. Preferred among these is guarana, ginseng, ginko. Besides serving as sources of stimulants, tea extracts and coffee can also be used as a flavoring agent. In particular, the combination of tea flavors, preferably green tea or black tea flavors (preferably green tea), optionally together with fruit flavors has an appealing taste.

The flavor agent can also comprise a blend of various flavors. If desired, the flavor in the flavoring agent may be formed into emulsion droplets which are then dispersed in the beverage composition or concentrate. Because these droplets usually have a specific gravity less than that of water and would therefore form a separate phase, weighting agents (which can also act as clouding agents) can be used to keep the emulsion droplets dispersed in the beverage composition or concentrate. Examples of such weighting agents are brominated vegetable oils (BVO) and resin esters, in particular the ester gums. See L. F. Green, Developments in Soft Drinks Technology, Vol. 1, Applied Science Publishers Ltd., pp. 87-93 (1978) for a further description of the use of weighting and clouding agents in liquid beverages. Typically the flavoring agents are conventionally available as concentrates or extracts or in the form of synthetically produced flavoring esters, alcohols, aldehydes, terpenes, sesquiterpenes, and the like.

Optionally, one or more preservatives may additionally be utilized herein. Preferred preservatives include, for example, sorbate, benzoate, and polyphosphate preservatives. Preferably, wherein a preservative is utilized herein, one or more sorbate or benzoate preservatives (or mixtures thereof) are utilized. Sorbate and benzoate preservatives suitable for use in the present invention include sorbic acid, benzoic acid, and salts thereof, including (but not limited to) calcium sorbate, sodium sorbate, potassium sorbate, calcium benzoate, sodium benzoate, potassium benzoate, and mixtures thereof. Sorbate preservatives are particularly preferred. Potassium sorbate is particularly preferred for use in this invention.

Wherein a composition comprises a preservative, the preservative is preferably included at levels from about 0.0005% to about 0.5%, more preferably from about 0.001% to about 0.4% of the preservative, still more preferably from about 0.001% to about 0.1%, even more preferably from about 0.001% to about 0.05%, and most preferably from about 0.003% to about 0.03% of the preservative, by weight of the composition. Wherein the composition comprises a mixture of one or more preservatives, the total concentration of such preservatives is preferably maintained within these ranges.

In addition to beverages, and liquid or powdered concentrates, the present invention can also be prepared in the form of an ice cream, yogurt or pudding composition depending upon consistency and storage temperature as is generally known to the skilled artisan.

The nano- to microbubbles of the foam are produced in a specially designed device of relatively simple construction. A rotor spins in the center of a cylindrical housing to generate flow and entrap air. Near the circumference of the housing is a stationary membrane having pores that correspond to the desired bubble size. As the agitated fluid passes the membrane at the surface of which the bubbles are created, a large number of uniformly sized air bubbles result. A liquid stream, generally water, is passed by the outer surface of the membrane to create either laminar flow fields, Taylor vortex flow or turbulent eddy currents that carry the bubbles away. This creates a uniform and continuous supply of air bubbles that are of the desired size (e.g., below 10 microns).

When an ice cream is to be made, the foam can simply be frozen. As the air bubble size is selected to have very small interstitial spaces where ice crystals can grow, the perception of the consumer is of a very smooth and creamy product. A preferred size for this purpose is interstitial spaces that are less than 50 microns in length at its greatest dimension. By controlling this spacing to such a small size, any ice crystals that form therein have a dimension that is smaller than the spacing, and at that small size such crystals are not taste perceptible. This renders any frozen products with a smoother consistence and with the avoidance of large ice crystals that detract from the palatablility of the product. This product shows that due to the smaller size of the bubbles, the interstitial space available for ice formation is very small, thus preventing the formation of compact large 3D ice crystals.

As the bubbles are of uniform small size, they act as if they are rigid spheres and have almost no tendency to coalesce and form larger bubbles. Thus, ice cream and other products made from such a foam have excellent freeze thaw resistance since the bubbles remain stable and prevent ice crystal growth in the interstices between the bubbles to any taste perceptible size. This enables such products to melt and re-freeze without losing the smooth consistency and without generating large ice crystals or losing foam stability. Very good results are achieved using a 30% sugar solution as a liquid matrix into which the bubbles are generated.

A preferred aspect of the present invention relates to a frozen aerated edible foam product with a novel microstructure characterized by superfine gas bubbles, small and loosely interconnected ice crystals, multiple freeze-thaw stability and having a new sensory characteristics manufactured from an ambient foam by quiescent freezing. The manufacturing of the ambient foam includes a novel aeration of a sugar-water mixture, and thus certain aspects of the present invention are related to a rotating membrane device and a process for the gentle mechanical generation of superfine gas dispersions or micro-foams with narrowly distributed gas bubble sizes.

Another embodiment of the present invention enables the formation of a frozen edible foam product that is created by the following process. The process includes forming an unfrozen edible foam product, where the forming involves the preparation and ripening of a mixture and thereafter aerating the mixture. The aerated mixture is then quiescently frozen to form ice crystals having a mean ice crystal mean diameter $X_{50,0}$ below approximately 50 microns.

The novel frozen edible foam product has a creaminess of texture defined by having a superfine air cell size having a mean air cell diameter no greater than approximately 15 microns. Furthermore, the edible foam has a scoop ability characteristic defined by having a mean ice crystal diameter below approximately 50 microns, as well as improved multi-cycle freeze thaw stability.

Another major advantage of the novel product relates to processing by a very simple freezing process, which is applied to the foam generated at ambient temperature and filled into appropriate beakers/containers under quiescent conditions. This provides major cost savings with respect to the processing equipment, because continuous freezers are not required.

The novel product described above provides multiple freeze thaw stability not known before, due to its finely dispersed, narrowly size distributed and stable air cell/gas bubble structure. This also enables a pronounced creaminess, reduced coldness and extraordinary shape retention behavior during melting. The reduced fat content of less than or about 0-5% fat supports a health supporting or "premium light" character. The small and narrowly size distributed air cell/bubble structure also allows for remarkable cost savings for stabilizing ingredients.

In addition, the multi-cycle freeze thaw stability is defined by the mixture having about 0.1 to 2% by weight of an emulsifier, to form lamellar or vesicular phases and about 0.05 to 1.25% by weight of a stabilizer such as a gum. The function of this component is to increase fluid matrix viscosity for improved bubble and fluid entrapment and consequently improved stabilization. Also, the emulsifier is in an emulsifier-specific concentration range, and where the lamellar or vesicular phases of the emulsifier are formed at or in the vicinity of the gas/fluid interfaces of the foam product. In addition, charged molecules can be used which can incorporate into the lamellar phase structure and due to repulsive electrostatic forces cause swelling of the lamellar phase, so as to increase the multi-cycle freeze thaw stability of the foam structure.

Figure 4:
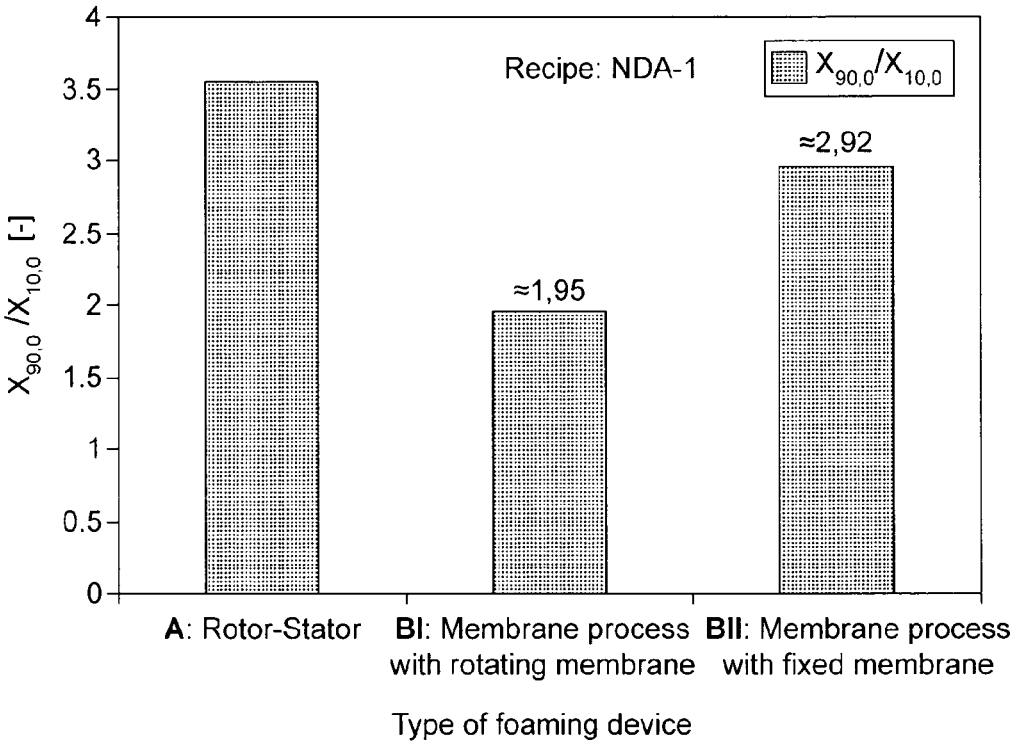
FIG. 4 is a graph indicating the bubble size distribution width or "narrowness" for three different aeration process/device embodiments of the invention.

The edible frozen foam product has mean bubble diameters below 10 micron, a narrow bubble size distribution ($X_{90,0}/X_{10,0} \leqq 3.5$ as shown in FIG. 4) and in general high gas volume fraction (>50% vol.), which are whipped under ambient temperature conditions, filled into cups/containers and then frozen, e.g. in a freezing tunnel down to −15° C. without pronounced gas bubble enlargement and without generation of pronounced solid body behavior or iciness.

The novel frozen edible foam product has a caloric content for the frozen foam product with an overrun of approximately 100% that is less than approximately 55 kcal/100 ml. As used herein, overrun is defined as the ratio of (density of mix−density of foam sample)/(density of foam sample), or in other words, overrun is a measure of the increase of volume by added air, i.e. the percent increase in volume of product due to incorporation or entrapment of air bubbles. This low caloric content is a significant improvement over other low calorie deserts, where such light deserts have an equivalent caloric content per serving that is about 250 kcal for a bubble-free 100 ml serving. This can be compared to the so-called premium ice creams that have a caloric content of about 280 kcal/100 ml even at an overrun of 100% which is about 560 kcal per bubble-free 100 ml serving. As is known to a skilled artisan in this field, a gas volume fraction of between 30 and 60% is equivalent to about 40-150% of overrun. Thus, a product having a caloric value of 60 kcal per 100 ml serving at 200% overrun is equivalent to a caloric value of 120 kcal per 100 ml serving at a 100% overrun and 240 kcal per 100 ml with no overrun. Thus the term "bubble-free" is used herein to designate those servings that have not been subjected to an overrun and can be used as a basis for comparison with prior art ice cream formulations.

In its most preferred embodiment, the present invention is directed to a process and composition for a novel low fat frozen foam product by freezing an ambient foam under quiescent freezing conditions without forming large gas bubbles or interconnected ice crystals and subsequent solid body behavior. The process enables the formation of the novel composition having an improved multiple freeze-thaw cycle stability and new adjustable texture properties, in particular for preparing novel ice cream products.

Generally the freezing temperature of the liquid of the matrix is used to determine the temperature where the foam can be frozen. In certain situations, the liquid matrix includes other components or ingredients that affect the freezing temperature of the liquid so that the freezing temperature of the matrix may be below that of the liquid. The skilled artisan can conduct routine tests to determine the appropriate freezing point for any particular matrix composition. Therefore when the specification refers to the freezing temperature of the foam, it is understood that this means the temperature at which the matrix and its components will freeze.

In the description that follows, characteristic product properties were obtained from an exemplary foam product recipe (referred as the NDA-1 recipe), having the following composition:

24% sucrose
3% glucose syrup
3% dextrose (28DE)
0.6% emulsifier PGE (poly glycerol ester)
0.25% guar gum stabilizer One embodiment of the present invention enables the formation of a frozen edible foam product that is created by the following process. The process includes forming an unfrozen edible foam product, where the forming involves the preparation and ripening of a mixture and thereafter aerating the mixture. The aerated mixture is then quiescently frozen to form ice crystals having a mean ice crystal diameter below approximately 50 microns.

The novel product described above provides multiple freeze thaw stability not known before, due to its finely dispersed, narrowly size distributed and stable air cell/gas bubble structure. This also enables a pronounced creaminess, reduced coldness and extraordinary shape retention behavior during melting. The reduced fat content of 0 to 5% fat supports a health supporting or "premium light" character. The small and narrowly size distributed air cell/bubble structure also allows for remarkable cost savings for stabilizing ingredients.

Another major advantage of the novel product relates to processing by a very simple freezing process, which is applied to the foam generated at ambient temperature and filled into appropriate beakers/containers under quiescent conditions. This provides major cost savings with respect to the processing equipment, because continuous freezers are not required.

In one aspect, the frozen edible foam product has a superfine air cell size having a mean air cell diameter lower than approximately 10 microns to 15 microns. The frozen edible foam product is also characterized by having a narrow bubble size distribution with ratio of $X_{90,0}/X_{10,0}$ is no greater than approximately 2-3.

The novel frozen edible foam product has a creaminess of texture defined by having a superfine air cell size having a mean air cell diameter no greater than approximately 15 microns. Furthermore, the edible foam has a scoop ability characteristic defined by having a mean ice crystal diameter below approximately 50 microns, as well as improved multi-cycle freeze thaw stability.

The multi-cycle freeze thaw stability is defined by the mixture having about 0.05 to 2% by weight of an emulsifier, to form lamellar or vesicular phases and about 0.05 to 0.5% by weight of an stabilizer such as guar gum or other gums, where the emulsifier is in an emulsifier-specific concentration range, and where the lamellar or vesicle phases of the emulsifier are formed in the liquid matrix and then located at or in the vicinity of the gas/fluid interfaces of the foam product. In addition, charged molecules can be used which can incorporate into the lamellar phase structure and due to repulsive electrostatic forces cause swelling of the lamellar phase as long as the pH is adjusted in the neutral domain around pH 7, so as to increase the multi-cycle freeze thaw stability of the foam structure.

In this frozen edible foam product, air cell interfaces are stabilized by multilayer mesomorphic (lamellar or vesicular) phases which are selectively adjusted in their swelling, water immobilization and structure stabilizing behavior by the addition of an amount of unesterified fatty acids under adjusted neutral pH and close to zero ion concentration conditions. The frozen edible foam product has an adjusted neutral pH of 6.8-7.0 and very low ion concentration in the range of de-ionized water during the preparation ripening of the mixture. Preferably, the frozen edible foam product has an adjusted pH of about 3.0 prior to the aeration of the mixture.

In one embodiment, the frozen edible foam product includes about 20-45% of dry matter consisting of 0-25% milk solids, 10-40% sugars, 0-10% fat, and combinations thereof. In some aspects, the frozen edible foam product also includes about 0.1 to 1% by weight of an emulsifier, to form lamellar phases and about 0.05 to 1.25% by weight of a stabilizer of a gum as disclosed herein. The emulsifier can be in an emulsifier-specific concentration range, where lamellar or vesicle phases of the emulsifier are formed at or in the vicinity of the gas/fluid interfaces of the foam product.

The frozen edible foam product can also use charged molecules under neutral pH conditions, which can incorporate into the lamellar phase structure and due to repulsive electrostatic forces cause swelling of the lamellar phase thus improving the stability of the foam structure. The frozen edible foam product can also use poly glycerol esters (PGE) of fatty acids as emulsifiers thus forming the lamellar or vesicle structures and unesterified fatty acids as the charged molecules incorporating into the lamellar or vesicular layers and causing the swelling of respective lamella/vesicle structure. The swelling can be controlled by controlling the concentration of added charged molecules which can incorporate into the lamellar phase structure and due to repulsive electrostatic forces cause swelling of the lamellar phase, thus improving the stability of the foam structure. In such a composition, the swelling of lamellar structures formed by polyglycerol esters of fatty acids is controlled by having a concentration of added unesterified fatty acids in the range of about 0.01 to 2% by weight.

The frozen edible foam product has a gas fraction in the foam that is adjustable to approximately 25 to 75% vol., and preferably in the range of 50-60% vol., and a caloric content for the frozen foam product with an overrun of approximately 100% that is less than approximately 55 kcal/100 ml. As used herein, overrun is defined as the ratio of (density of mix–density of foam sample)/(density of foam sample), or in other words, overrun is a measure of the added air, i.e. the percent increase in volume of product due to incorporation or entrapment of air bubbles.

The frozen edible foam product described above can be made by the following preferred method that includes the steps of forming a mixture by dissolving sugars and stabilizers in de-ionized water; adding an emulsifier to the mixture; heating the mixture to a temperature above the melting point of the emulsifier to dissolve the emulsifier into the mixture; homogenizing the mixture; cooling the mixture down to a cooling temperature less than about 10° C.; storing the mixture at the cooling temperature for approximately several hours; lowering the pH of the mixture into an acidic range; aerating the mixture to form the foam; and quiescently freezing the foam. In one aspect, the mixture is heated to a pasteurization temperature.

In another aspect, the sugars and stabilizers are dissolved in de-ionized water at 35-45° C. and pH adjusted to an approximately neutral condition before the adding of the emulsifier. The approximately neutral condition has a pH of about 6.8.

In another aspect, the emulsifier is dissolved at a temperature above approximately 20 to 60° C., more preferably at 80° C. with subsequent pasteurization for no less than approximately 30 seconds. In another aspect, the emulsifier is dissolved at a temperature above approximately 80° C. with subsequent pasteurization for no less than approximately 30 seconds.

In another aspect, the homogenizing is carried out as a one step homogenization at a homogenization pressure of not less than approximately 100 bars. Alternatively, the homogenizing is carried out as a one step homogenization at a homogenization pressure of approximately 150 bars.

After the homogenizing the mixture is cooled down to approximately 4° C. and stored for a time period of approximately more than 8 hours. Alternatively, after the homogenizing the mixture is cooled down to approximately 4° C. and stored for a time period of approximately more than 12 hours. Preferably, prior to the aerating the pH is lowered to less than approximately 3-4 by adding citric acid. While lowering the pH, salts may also be added to the mixture.

The aerating is carried out using a finely gas dispersing device. The device can be: a rotor stator whipping device, a static membrane whipping device, a rotating membrane whipping device, or combinations thereof. The aerating can be carried out in a temperature range of approximately 4 to 50° C.

In one embodiment, the rotating membrane whipping device is equipped with a controlled pore distance membrane having a 1-6 micron pore size and 10-20 micron of pore distance allowing for the fine dispersion with narrow bubble size distribution, and the membrane rotates with a circumferential velocity in the range of 5 to 40 m/s, wherein the narrow bubble size distribution is defined as a distribution with ratio $X_{90,0}/X_{10,0}$ no greater than approximately 3. In one aspect, the rotating membrane whipping device rotates within a cylindrical housing, forming a narrow annular gap of 0.1 to 10 mm with the membrane surface, thus allowing for improved detachment of more narrowly size-distributed air bubbles from the membrane surface.

The novel process described above allows for the formation of the novel foam structure with the novel superfine mean bubble diameters, very narrow size distribution with related high foam stability under ambient temperature and atmospheric pressure conditions (e.g., see Table 2). With a subsequent quiescent freezing the foam product freezes without significant coarsening of the foam bubble structure. As used herein, coarsening refers to the increase of mean bubble size, and size distribution width.

TABLE 2

Size and volume fraction ranges of disperse phases for the foam product

| | gas/air cells | water ice crystals |
|---|---|---|
| Mean diameter $X_{50,0}$/μm | 1-10 | 10-60 |
| volume fraction/ % vol. | 25-70 | 40-50 |

A further advantage of the novel foam product structure is the quiescent freezing process of the foam product. This quiescent freezing does not generate coarse and strongly interconnected ice crystal structure with subsequent significant hardness and iciness of the product.

FIG. 1 is an exemplary graph of air bubble size distribution function $q_o(x)$ (e.g., number density distribution) after dispersing treatment in a conventional rotor-/stator turbulent flow dispersing device with intermeshing pin geometry using the following conditions: recipe NDA-I, r.p.m.: 3500, gas volume fraction 0.5. bubble diameters $X_{10,0}$, $X_{50,0}$ and $X_{90,0}$ (values of the number distribution, $q_o(x)$), are 6.944, 13.667 and 24.713). While this is useful for certain foam embodiments, it is not preferred in order to obtain a multiple freeze-thaw stable foam.

Figure 2:
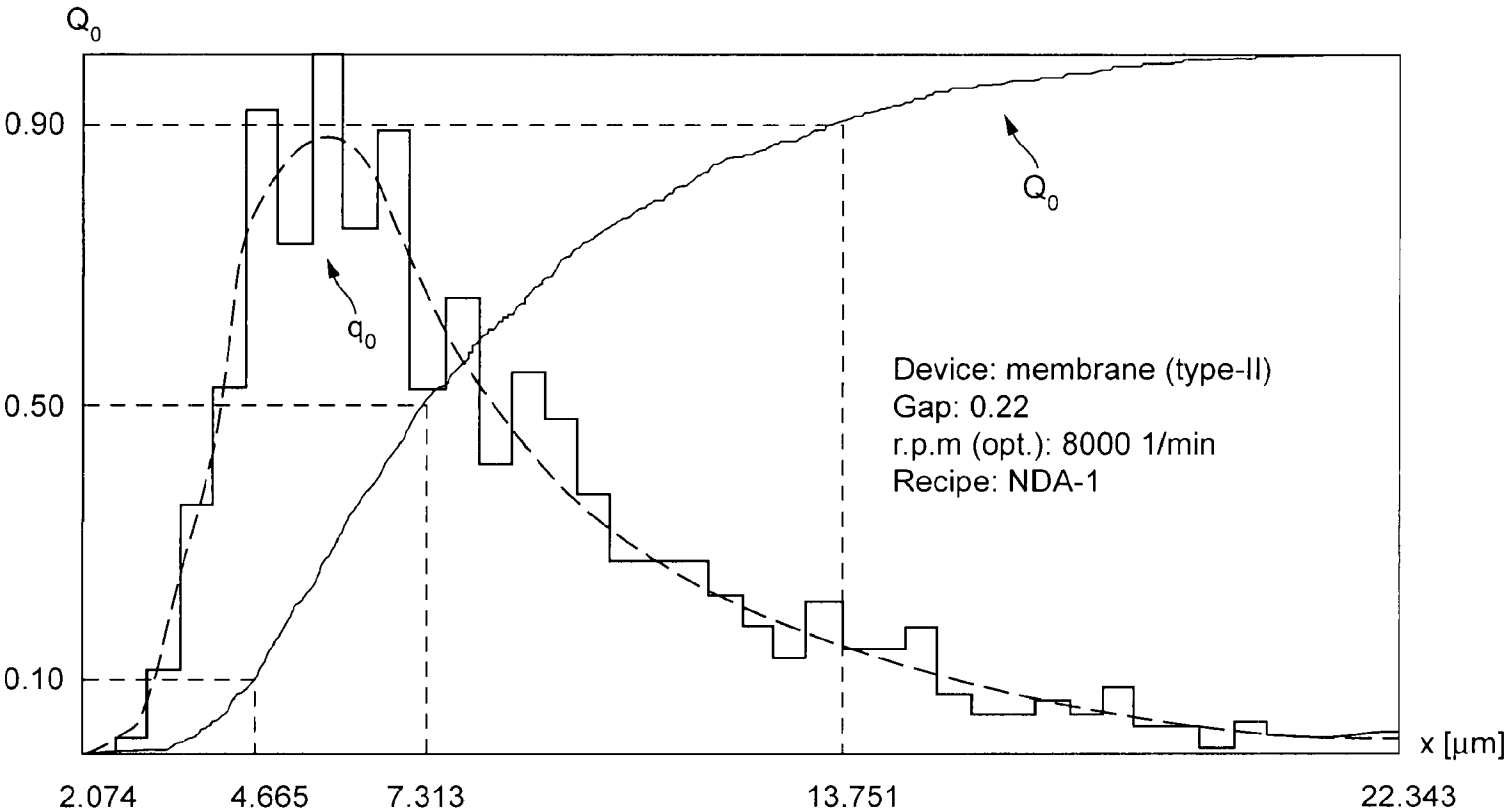
FIG. 2 is a graph of air bubble size distribution of a foam produced in accordance with one embodiment of the present invention.

FIG. 2 is an exemplary graph of air bubble size distribution function $q_o(x)$ (e.g., number density distribution) of the foam product in accordance with one embodiment of the present invention after aeration treatment in the novel laminar flow rotating membrane aeration device. The membrane was mounted on the rotating inner cylinder, with the following conditions: recipe NDA-1, gap: 0.22 mm, r.p.m.: 6250; gas volume fraction 0.5. FIG. 2 can be compared with the resulting distribution received from aerating the same model recipe (NDA-1) with a conventional rotor/stator (R/S) whipping device shown in FIG. 1. As can be seen, using the rotating membrane device leads to a much smaller bubble size and more tightly controlled bubble size distribution.

Figure 3:
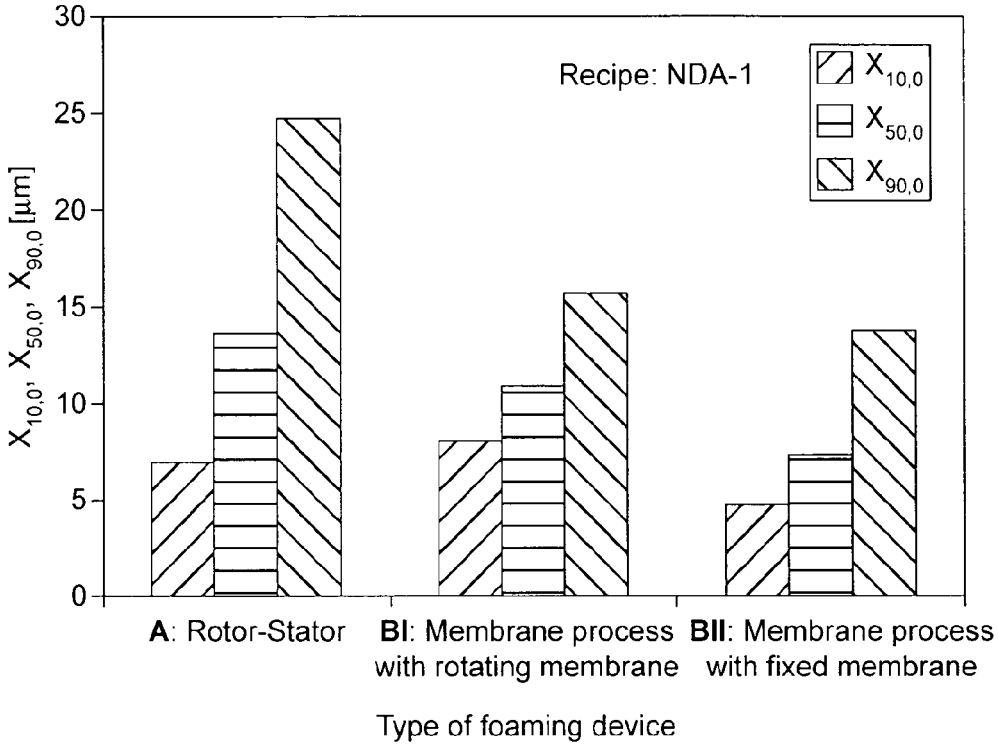
FIG. 3 is a bar graph that illustrates the $10^{th}$, $50^{th}$ and $90^{th}$ percentile of bubble diameters for three different aeration process/device embodiments of the invention.

The comparison of bubble sizes is also quantitatively shown in FIG. 3, which is an exemplary bar graph with bars showing the bubble diameters $x_{10,0}$, $x_{50,0}$ and $x_{90,0}$ for three different aeration process/device versions: a conventional rotor/stator intermeshing pin with turbulent flow characteristics (A), a novel membrane process/device type I with membrane mounted on rotating inner cylinder (B-Type I) and novel membrane process/device type II with fixed membrane at housing and rotating inner solid cylinder with smooth or profiled surface (B-Type II). The operating conditions for the B-Type II device were recipe NDA-1, gas volume fraction 0.5. Both the B-Type I and B-Type II devices produce significantly smaller bubble sizes and size distributions.

The reduced bubble size distribution width of the foam product processed in the rotating membrane device of the invention is demonstrated in FIG. 4, which is an exemplary graph of bubble diameter ratio $x_{90,0}/x_{10,0}$ indicating the bubble size distribution width or "narrowness" respectively for the three previously mentioned different aeration process/device versions. The $x_{90,0}/x_{10,0}$ ratio for the B-Type I and B-Type II devices are lower than that of the A-Type device with the B-Type I device providing nearly half as much as the A-Type device. This is related to the uniformity of the impacting shear forces at the membrane surface (Type-B devices) causing bubble detachment from the membrane surface compared to the much less uniform stress distribution causing the break-up of large bubbles into smaller ones within the heterogeneous stress distribution in rotor-stator gaps (A-Type).

A substantially uniform bubble size means that a majority of the bubbles are in a particular size range to avoid or reduce bubble disproportionation by gas transfer from the smaller to the bigger bubbles (Ostwalt Ripening). A substantially uniform bubble size distribution means that the particular bubble diameter ratio $x_{90,0}/x_{10,0}$ is less than about 5, preferably less than 3.5, even more preferably below 2 to 3.

Figure 5B:
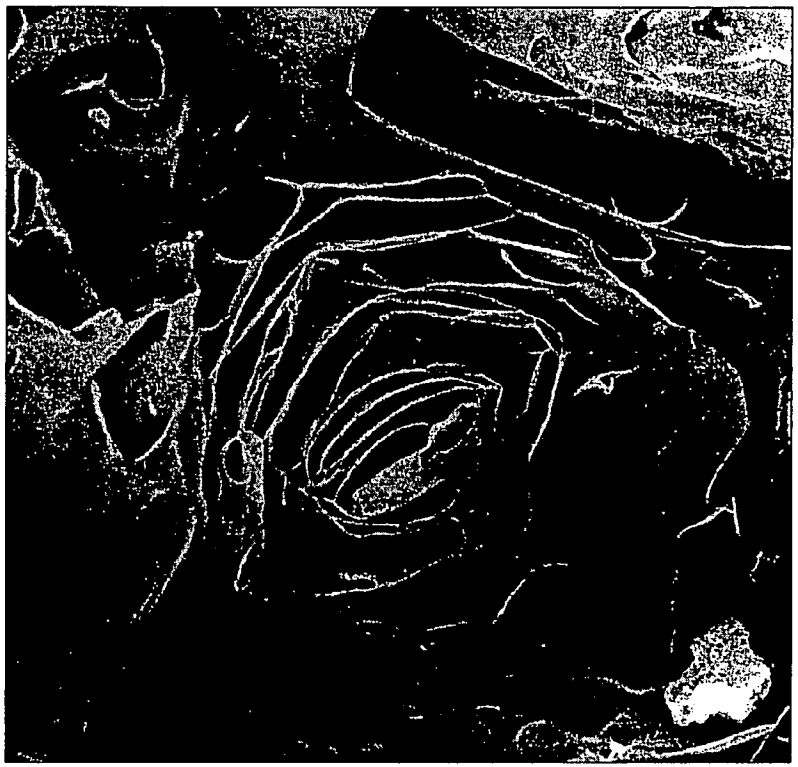
FIGS. 5A and 5B are Scanning Electron Micrographs of the lamellar cage structures of the foams of the invention.
Figure 5A:
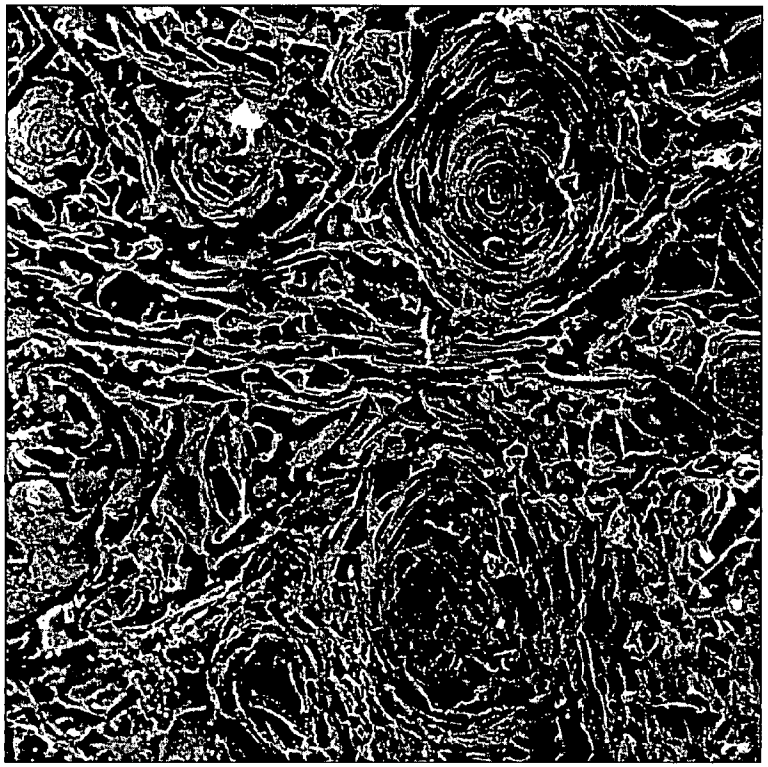
Figure 6:
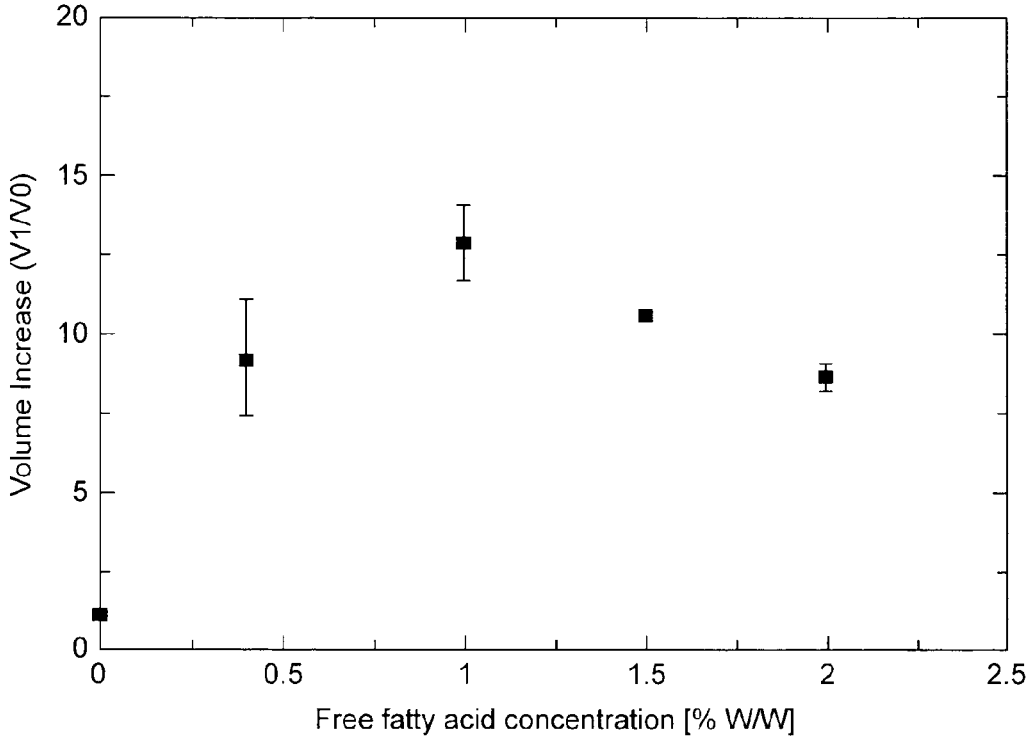
FIG. 6 is a graph showing the dependency of the lamellar phase volume as a function of added swelling agent concentration.
Figure 7:
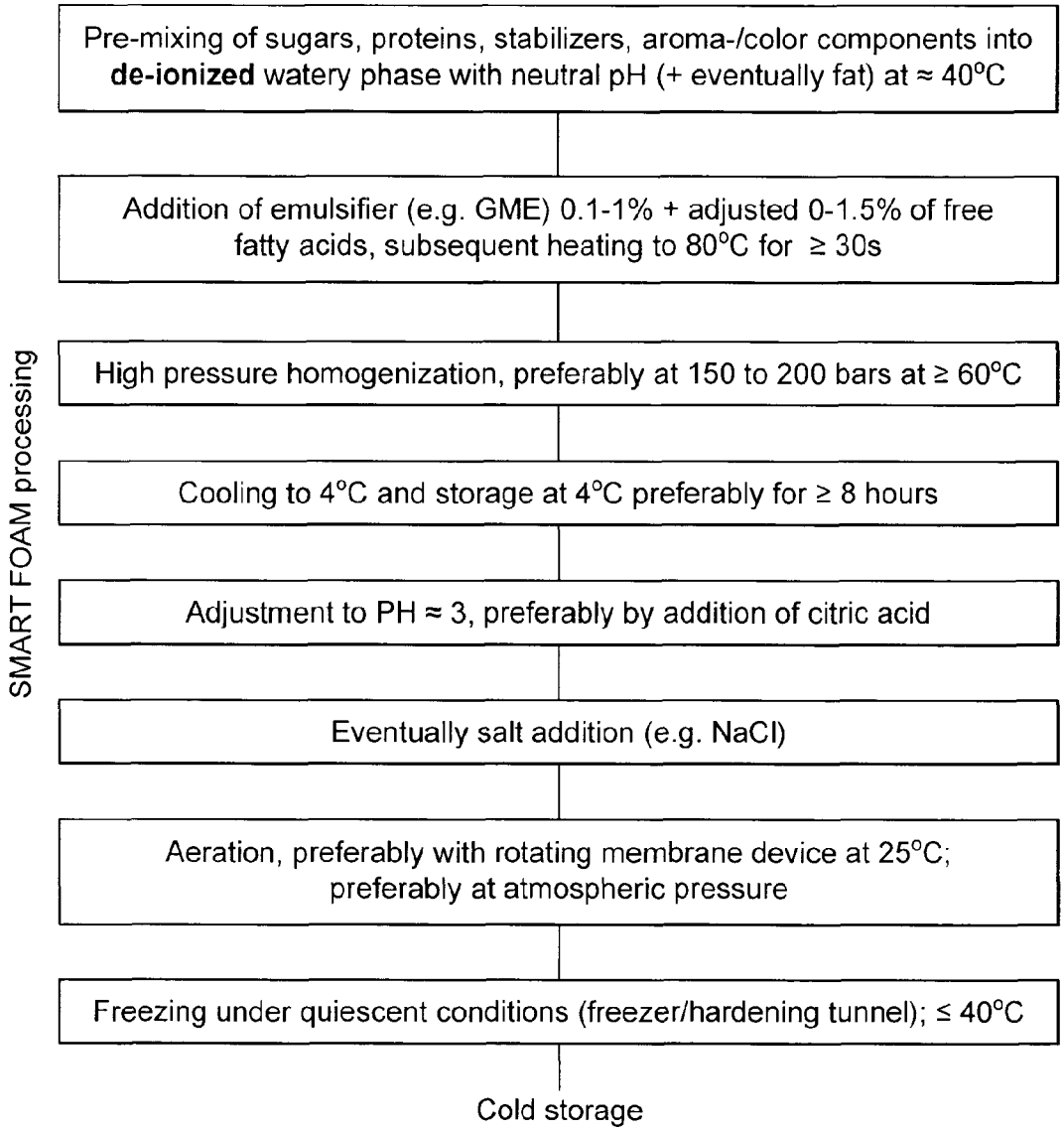
FIG. 7 is a process diagram that illustrates the steps for formation of the foam in accordance with the present invention.

Beside the different gas bubble structure characteristics of foam product, associated with the whipping device used, foam product characteristics are based upon its high structure stability resulting from the novel interfacial stabilization concept. This novel interfacial stabilization concept is based on the use of surfactant systems allowing for the formation of lamellar or vesicular interfacial structures for which in addition a swelling effect can be adjusted by implementing a controlled fraction of specific molecules into the lamellar/vesicular phase structure. FIG. 5 shows such a lamellar phase structure formed by poly glycerol esters of fatty acids (PGEs). FIG. 6 demonstrates the dependency of the lamellar phase volume (swelling) as a function of added non-esterified fatty acid concentration. However the swelling adjustment is best understood in the context of the novel process for the forming of the foam, shown in FIG. 7. This process comprises dissolving sugars and stabilizers in de-ionized water, adding the emulsifier and dissolving it at a temperature above its melting temperature, preferably at pasteurization temperature, coupled or separate pasteurization and subsequent one step homogenization, followed by cooling the mixture down to 5 to 10° C., and subsequent storage at this temperature for a time period of several hours. Final steps include lowering the pH into the acid domain, with subsequent aeration and quiescent freezing of the resulting foam.

Figure 8:
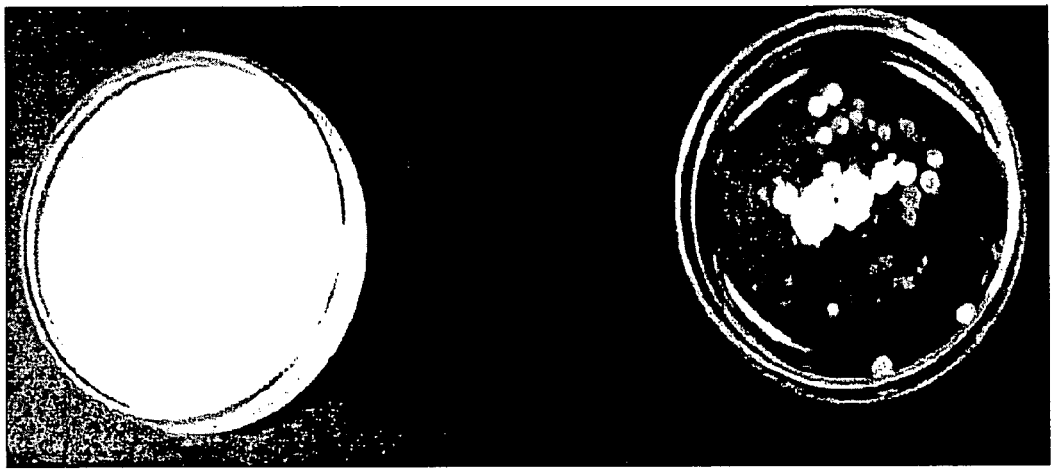
FIG. 8 illustrates the resulting product obtained if one changes the order of the heating step (I) and the pH adjustment step (II) which produces the foam, wherein the reverse order (II, then I) generates a pronounced structure collapse, without any foam.

FIG. 8 demonstrates the result for the lamellar/vesicular PGE phase structure if one changes the order of the heating step (I) and the pH adjustment step (II). The container on the left illustrates the fine bubble foam made from the correct order, while that on the right, made from conducting the reverse order of steps (II, then I) shows a pronounced structure collapse, without any foam stabilizing ability.

Figure 9:
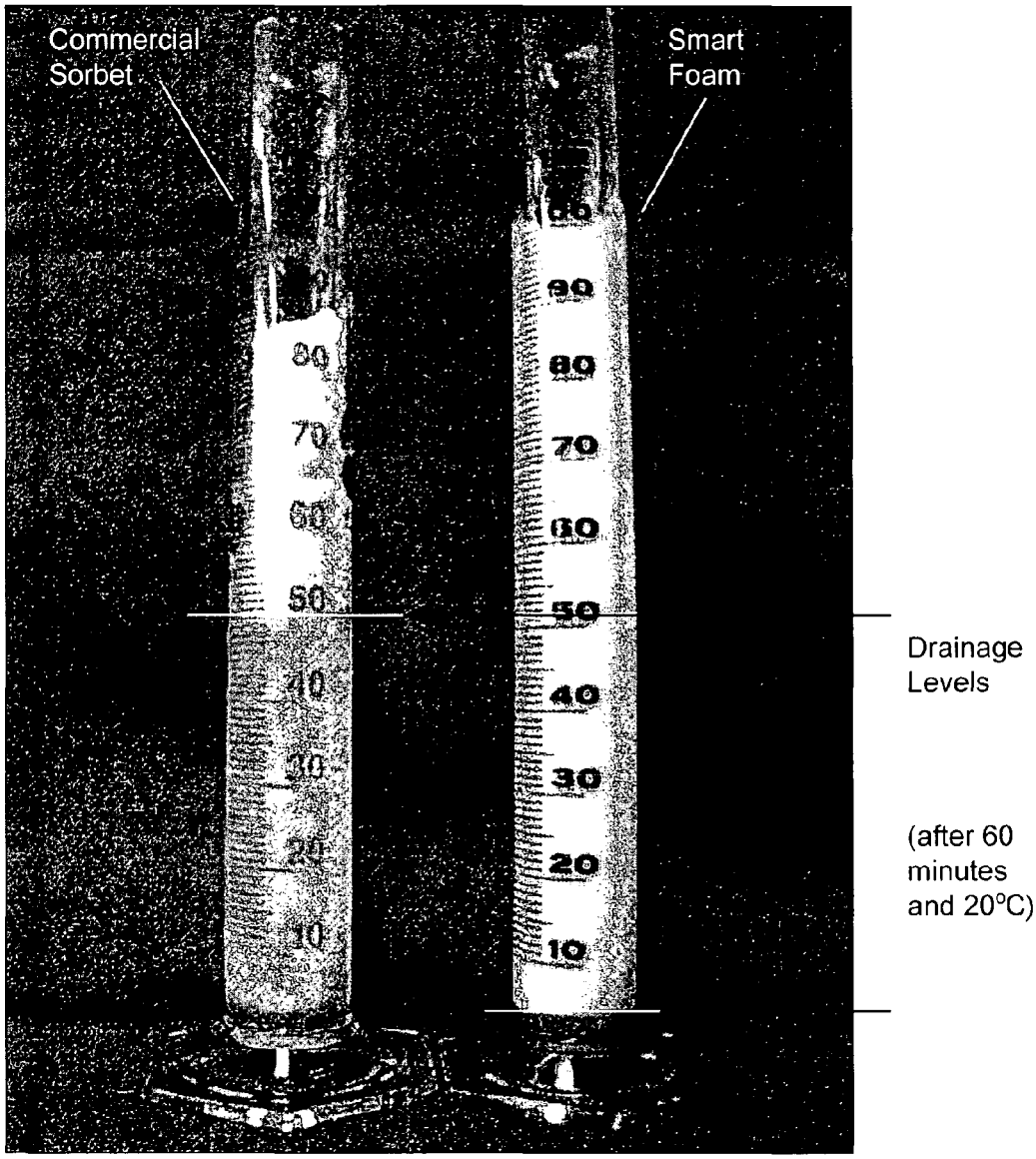
FIG. 9 is a photograph of two test tubes to compare the drainage characteristics of a foam according to the invention with that of a conventional sorbet.

In FIG. 9, the smart foam stability characteristics is demonstrated, expressed by the drainage characteristics (separated liquid after 60 minutes under ambient temperature and quiescent conditions. As can be seen from the drained watery fluid height, for a commercial sorbet (the cylinder on the left), this is about 15 times the height than for a smart foam sample (the cylinder on the right) under similar testing conditions. The present foam loses less than 2% volume in this test.

Figure 10B:
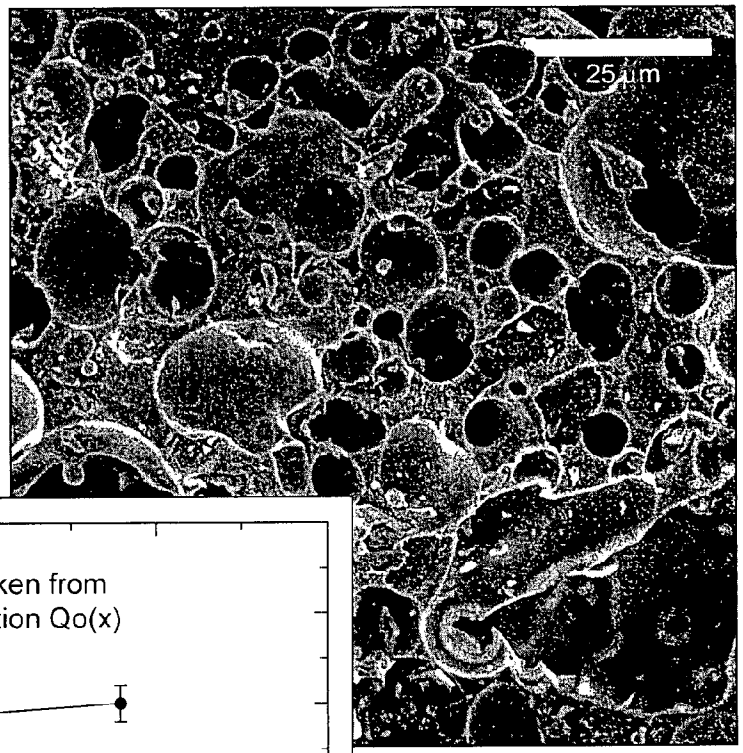
FIG. 10 is a graph of bubble diameters for foams that are subjected to heat shock, with FIG. 10A being a micrograph illustrating the bubbles prior to heat shock and FIG. 10B illustrating the bubbles after heat shock.
Figure 10:
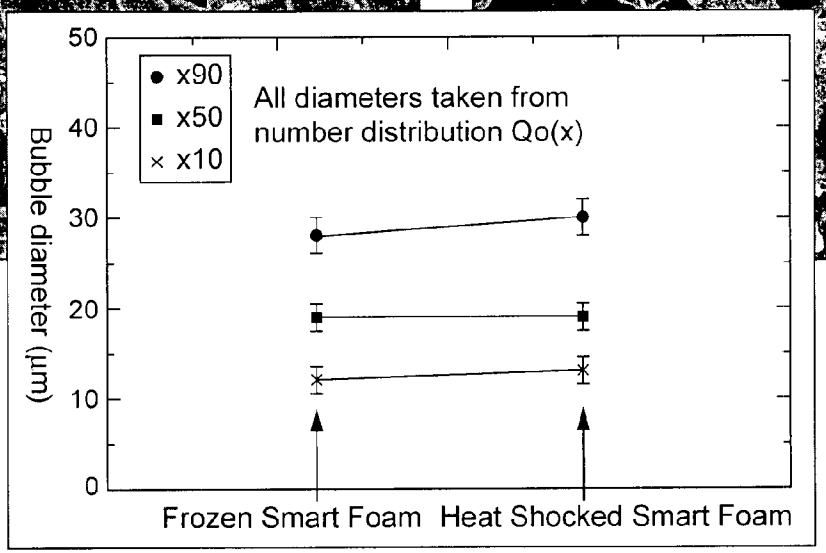
Figure 10A:
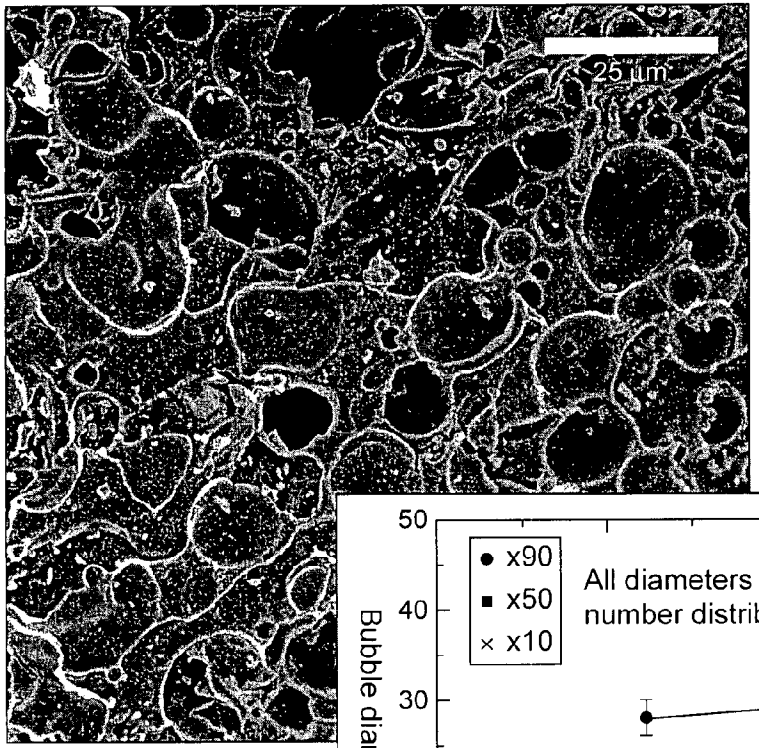

FIG. 10 demonstrates the smart foam stability under freeze-thaw conditions with respect to the gas bubble mean diameter. As can be seen from comparing the structure before (FIG. 10A) and after (FIG. 10B) the heat shock treatment, there is no significant change of the bubble size distribution. This denotes the innovative "multiple freeze-thaw stability" of smart foam.

Figure 11:
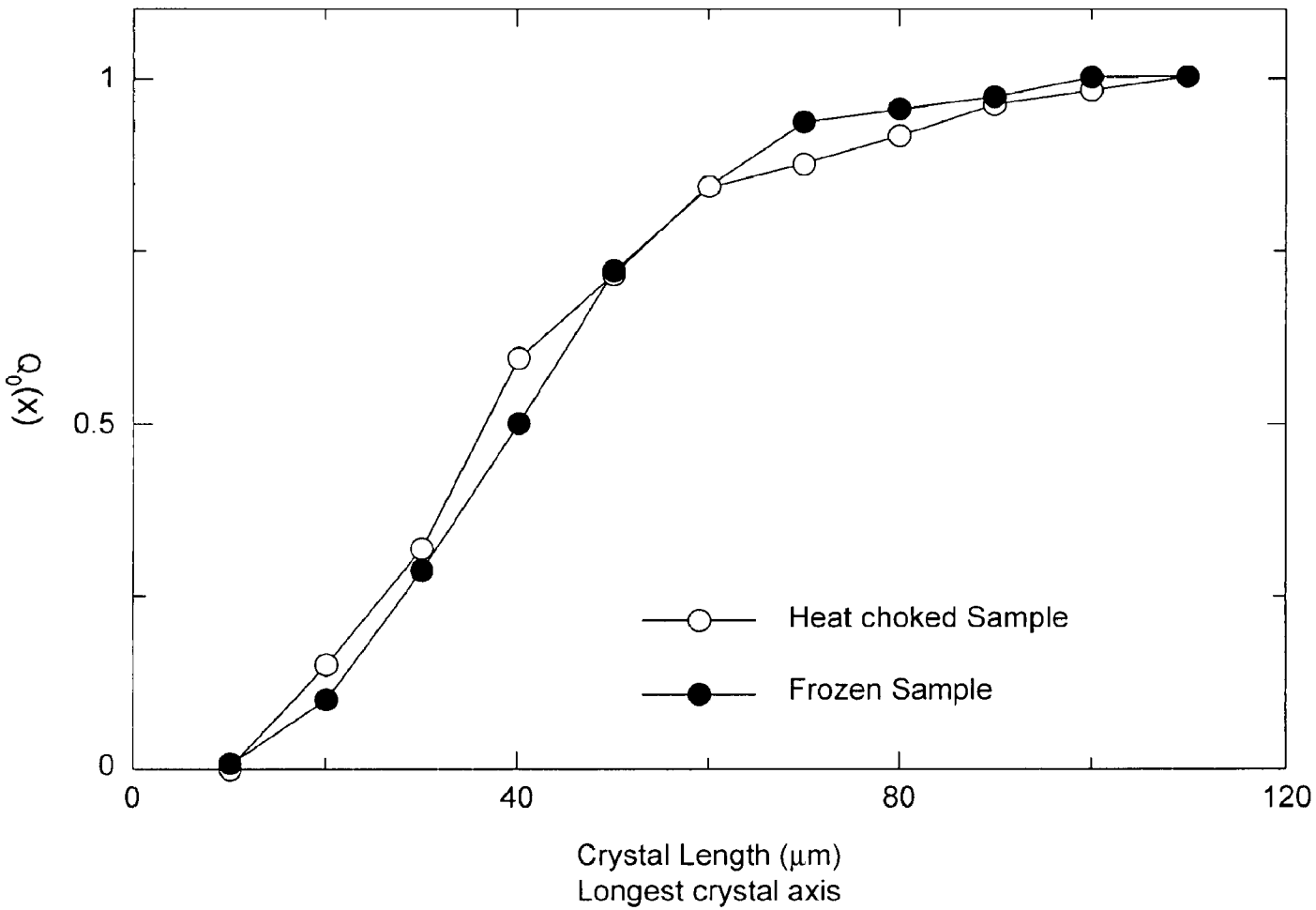
FIG. 11 is a graph that shows the heat shock behavior of a foam according to the invention.

FIG. 11 demonstrates as well the structural behavior under freeze-thaw conditions however with respect to the ice crystal mean diameter. Again there is no significant change seen in ice crystal size demonstrating the innovatively high "multiple freeze-thaw stability" of the smart foam.

Another embodiment of the present invention is directed to the novel device and techniques for aerating the liquid mixture described above to form the foamed product. In this regard, one embodiment of the present invention discloses a new process for the mechanically uniform and gentle generation of gas dispersions or foams with finely dispersed narrowly size-distributed gas bubbles.

In the process for the gentle mechanical generation of fine gas dispersions with narrowly distributed gas bubble sizes, the bubbles are generated at the surface of a membrane and from which their detachment is efficiently caused either by rotational motion of the membrane within the continuous fluid phase and/or by rotational flow of this fluid phase across the membrane applying due to acting superimposed shear, elongation and normal stresses.

The method for the gentle mechanical generation of gas dispersions or foams having superfine bubbles narrowly distributed in size, includes: providing a membrane (or porous medium) forming at least one surface of a two-surfaced narrow gap; delivering a gas through the pores of the membrane, the gas forming bubbles or gas filaments when delivered through the pores of the membrane; detaching the bubbles or gas filaments from the gap bordering surface of the membrane; and mixing the bubbles or gas filaments within a continuous liquid fluid phase, the liquid fluid phase being present in the gap.

In one aspect, the detaching and the mixing are carried out by any of the following mechanisms: a homogeneously acting shear stress, elongation stresses, inertia stresses, and combinations thereof, caused by the motion of one of the gap surfaces relative to the other.

In one aspect, the delivering of the gas includes pushing the gas through the pores of the membrane. The pushing can be carried out by pumping, vacuuming, or sucking the gas through the pores of the membrane. The liquid phase can also be pumped through the gap.

In one aspect, the gap is formed between two surfaces, at least one of which includes the membrane. The gap can be formed between two rotation symmetric bodies one concentrically inserted into the other, the second consequently forming a housing around the first and a concentric or eccentric gap between the bodies. Alternatively, the gap can be formed between two rotation symmetric bodies one eccentrically inserted into the other, the second consequently forming a housing around the first and an eccentric gap between the bodies. In addition, both surfaces of the gap can be formed by membranes.

While either or both surfaces of the gap can be made of a membrane material, either the inner or the outer gap surface is moved relative to the other. The movement can be at a fixed or at a variable or adjustable fixed or periodically oscillating surface, circumferential velocity, or at a controlled velocity-time history with respect to the other surface.

The gas flow rate through the membrane can be at a constant or varying, or periodically varying flow rate.

The liquid flow can move relative to the gap surfaces in either one of the following flow regimes: pure laminar shear flow, mixed laminar shear and elongation flow, Taylor vortex flow, inertia driven turbulent flow in the laminar to transient flow regime conditions, and combinations thereof. The flow regime of the liquid within the gap can be adjusted to generate well defined shear, or elongation or inertia stresses detaching the gas bubbles of filaments from the membrane surface. Furthermore, in addition to the flow generated in the gap caused by the motion of at least one of the gap surfaces, a flow through fluid velocity component can be generated by pumping the continuous liquid fluid phase through the gap. In one aspect, the relative circumferential velocity of the gap surfaces can be in the range of 1 to 40 m/s with respect to one-another. Likewise, the continuous liquid fluid phase axial mean velocity in the gap can be adjusted within a range of approximately 0.01 to 5 m/s.

In another aspect, the applied trans-membrane pressure to the gas phase can be within a range of approximately 0.05 to 5 bar. Likewise, the axial cross-membrane pressure applied to the liquid fluid phase can be within a range of approximately 0.01 to 10 bar. In another aspect, the gap is controlled by a back pressure valve adjusted in a range of approximately 1 to 5 bar absolute pressure.

Yet another embodiment of the present invention relates to a device for carrying out this novel foaming process using either a membrane installed on a rotating body, surrounded by a concentric or eccentric housing forming a narrow flow gap with the rotating body, or using the reverse construction with a membrane installed in the concentric or eccentric housing and a solid rotating body forming the respective flow gap with the membrane or housing. Within the concentric or eccentric flow gap locally formed flow restrictions are provided in order to generate local flow contraction causing elongation flow components and/or turbulent flows. In addition to the rotational flow component generated by the rotating body motion, there is an axial flow component generated due to the pumping of the continuous fluid phase continuously through the dispersing flow gap.

The above-described novel aeration process is advantageous in that it enables the gentle dispersing of gas/air bubbles under laminar flow conditions, which has not been applied before to finely dispersed gas/liquid dispersions.

In addition, the reduced volume specific power or energy input during processing allows for better control of viscous friction energy dissipation and related temperature increase in the system, thus allowing for better protection of mechanical and heat sensitive system components.

Furthermore, as a result of the balance of evenly distributed shear and elongation forces or stresses dominating the bubble dispersing process and less relevant disturbing influence of centrifugal de-mixing forces or stresses supporting bubble re-coalescence, coupled with an initial dispersing step by the membrane pores, very finely dispersed bubbles which are in addition narrowly distributed in size, are generated. Consequently the microstructure related foam product properties can also be adjusted in a more distinct manner compared to gas dispersions/foams resulting from conventional whipping/aeration technologies.

Additionally, the adjustable rotational flow component gives independence of the acting dispersing stresses applied for bubble detachment from the membrane surface, bubble deformation and bubble break-up, from the volume/mass flow rate through the continuous process.

Moreover, for higher gas fractions the novel gentle gas bubble dispersing allows for further bubble size refinement with increasing gas fraction, which is not the case for the conventional rotor/stator based intermeshing pin techniques with turbulent dispersing flow characteristics.

The novel apparatus described above has several advantages, and allows for the simple modification and adjustment of the desired shear and/or mixed shear and elongation membrane overflow/dispersing flow characteristics, supporting the efficient detachment and break-up of bubbles. In part, due to the large density difference between the two phases (gas/liquid) a moderate increase of the trans-membrane pressure shifts the bubble dispersing mechanism from half spherical to spherical bubble detachment from the membrane surface to gas filament shooting through the pores into the continuous fluid phase leading to gas filament elongation and break-up supported by additionally superimposed shear- and relaxation effects.

The filament shooting or elongation mechanism can be further supported by acting centrifugal forces when the membrane is installed at the non-rotating inner housing wall.

Additional freedom to improve the drop detachment/filament break-up efficiency is given by the facilitated application of superimposed elongation flow characteristics due to eccentric adjustment of the rotating part (e.g., the inner cylinder).

Due to the highly efficient and novel bubble dispersion, there is a much shorter residence time required in the dispersing gap compared to conventional devices. This in turn leads to an advantageously compact and high throughput apparatus which is advantageous for increased capacity and/or production cost reduction for the related foam product production.

The bubble size of the foam can further be controlled during manufacture by selecting or changing certain variables or parameters. Even so, the bubble size distribution remains tight and as disclosed herein so that a uniform stable foam is generated. A first variable is the type of device to use, as each gives a slightly different range of bubble sizes. This is likely due to the gap between the membrane and the housing. Generally, all other parameters being equal, the larger the gap between the two, the greater the bubble size. After selecting the desired device and gap, the rotational speed of the device can be varied to obtain the desired bubble size, with the slower rotational speeds generally resulting in the production of larger size bubbles. Another variable that can be controlled is the recipe of the liquid matrix, both as to the type of liquid and the desired additives or components that are included. Generally, a lower amount of emulsifier would result in larger bubbles, while increasing the amount of emulsifier provides sufficient material to form a cage structure that can accommodate smaller size bubbles. As smaller bubbles have a larger surface area than larger bubbles, a greater amount of emulsifier is needed to coat the bubbles and form the cage. It is interesting to note that it does not appear that the bubble sizes to be generated do not depend upon the pore size of the membrane or on the viscosity of the matrix.

Further process and device characteristics as well as related advantages compared to the state of the art are given in further detail in the following description and the accompanying drawings in which certain embodiments of the invention and their related properties are described.

Figures 12A, 12B:
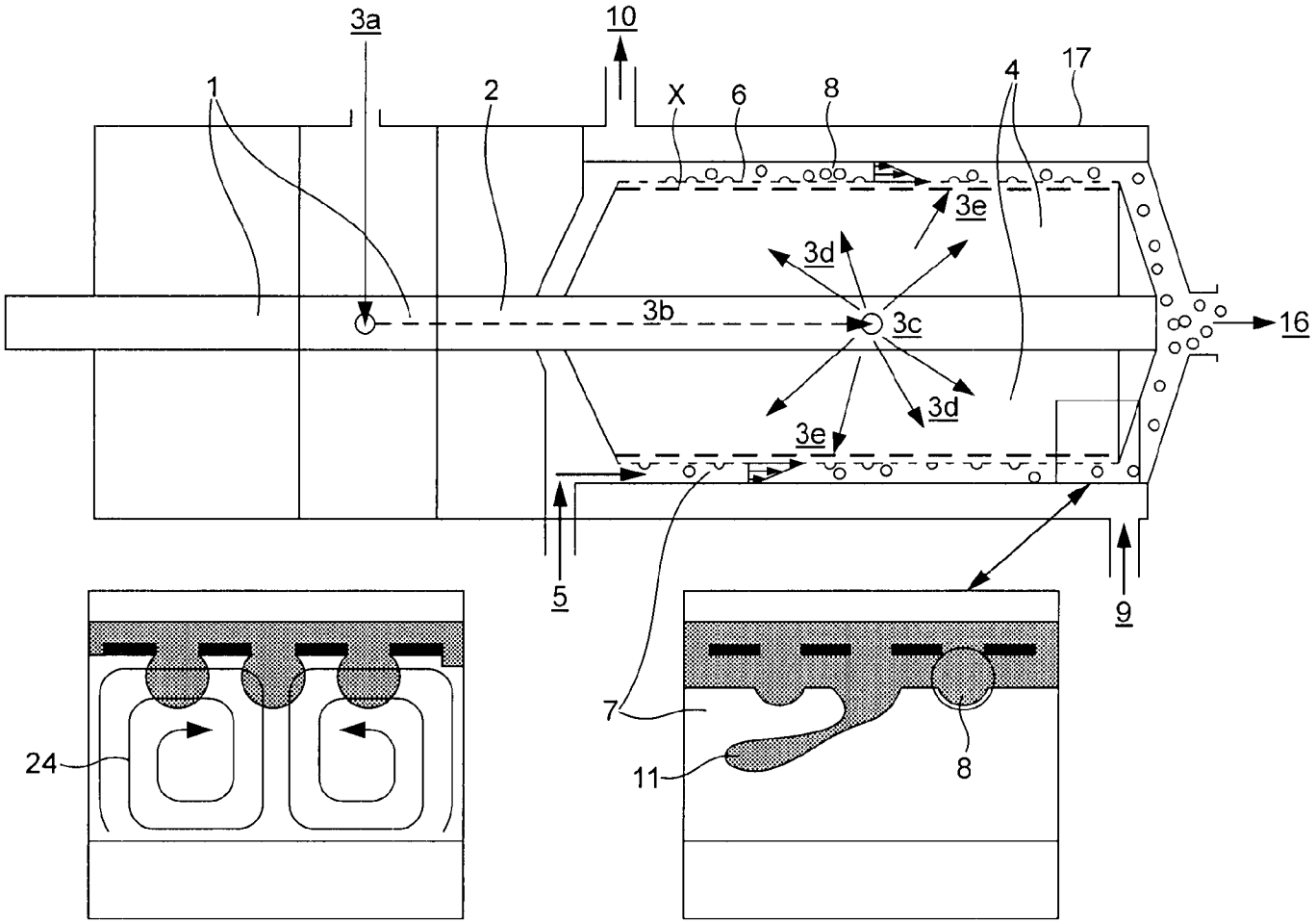
FIG. 12 is a schematic drawing of a first embodiment (Type I) of the aerating device of the invention showing an axial cut through the device with the membrane installed at the surface of the rotating inner part (i.e., cylinder), with the magnified gap sections of FIG. 12A and FIG. 12B showing compact gas entity at the membrane surface.

FIG. 12 shows a schematic diagram of the novel membrane process/device (Type B I) with the membrane mounted on rotating inner cylinder (Type I), in accordance with a first embodiment of the invention. In FIG. 12, (1) denotes two double-sided slide ring sealings allowing the delivery of gas/air without leakage through the rotating hollow shaft (2). The gas/air enters the shaft at the gas/air inlet (3*a*) flows through the inner shaft channel (3*b*) and leaves the shaft again through holes (3*c*) into the hollow rotating cylinder (4), which at its surface holds the membrane (6). The gas/air is evenly distributed in the hollow cylinder (3*d*) and from there pressed through the membrane pores (3*e*) into the dispersing flow gap (7) forming bubbles at the membrane surface (8) or shooting as gas/air filaments (11) into the gap. The continuous liquid fluid phase enters the dispersing device at the fluid/mix inlet (5). As soon as the fluid/mix enters the dispersing gap (7) the dominating rotational flow component overlays the axial throughput flow component. Within the gap flow field gas bubbles (8) are detached from the membrane surface and gas filaments (11) broken up under very uniform stress conditions acting in the narrow flow gap (7). This is more clearly seen in FIG. 12A. The gas dispersion/foam leaves the device at the foam outlet (16). The cylindrical housing (17) is in general constructed as a cooling jacket in order to transfer dissipated viscous friction heat to a cooling agent, which enters the cooling jacket at the cooling agent inlet (9) and leaves it at the cooling agent outlet (10).

Figure 13:
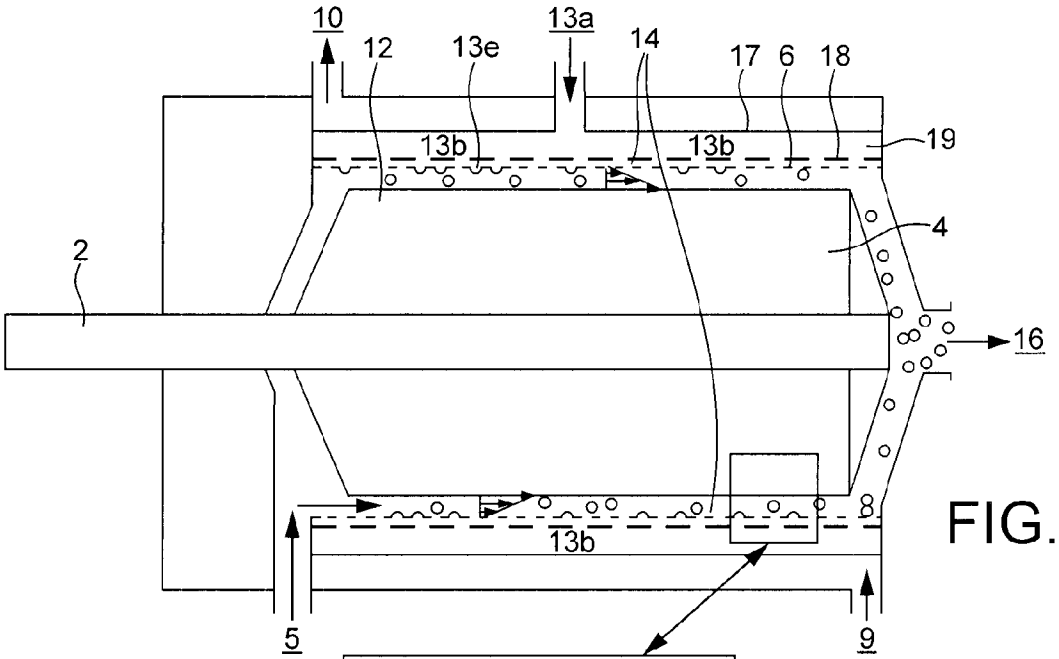
FIG. 13 is a schematic drawing of a second embodiment (Type II) of the aerating device of the invention showing an axial cut through the device with the membrane installed at the surface of the fixed outer part (cylindrical housing), with the magnified gap section of FIG. 13A showing gas filaments shooting from membrane pore into the gap.

FIG. 13 shows additional information for the novel membrane process/device Type B II with the membrane mounted on the fixed housing (Type II), in accordance with a second embodiment of the present apparatus. The shaft (2) and the connected cylinder (4) are no longer part of the aeration system. The membrane (6) is mounted onto a cage construction (18) connected to the inner surface of the cylindrical housing (17) and forming a gas/air chamber (19) between the inner housing wall and the membrane. Through a central gas/air inlet (13*a*) the chamber (19) is supplied with gas/air, which is evenly distributed (13*b*) and pressed through the membrane pores (13*e*) into the dispersing gap (7).

The continuous fluid flow and its impact on the dispersing procedure is expected to be similar to the type I version of the process described above (FIG. 12), except the different impact of the centrifugal forces which in this type II device support more gas phase shooting into the dispersing flow gap, forming preferably gas/air filaments (11), whereas in the type I device the centrifugal forces work against the shooting mechanism thus giving higher preference to the formation of bubbles at the membrane surface. However this depends on the gas volume flow rate and the trans-membrane pressure applied. In a second magnified section of the gap between membrane and outer cylinder a Taylor vortex flow pattern (24) which contributes to an improved bubble detachment from the membrane is shown in FIG. 12B.

Figure 13A:
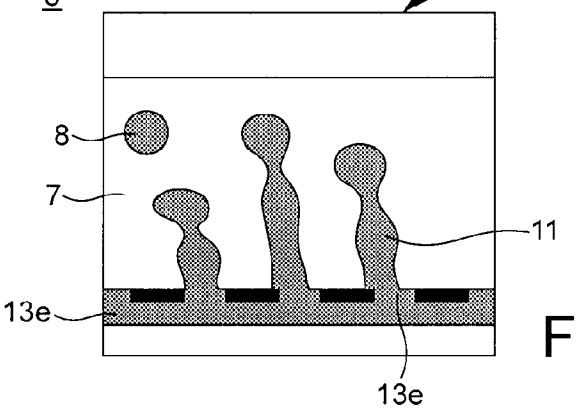
Figure 16:
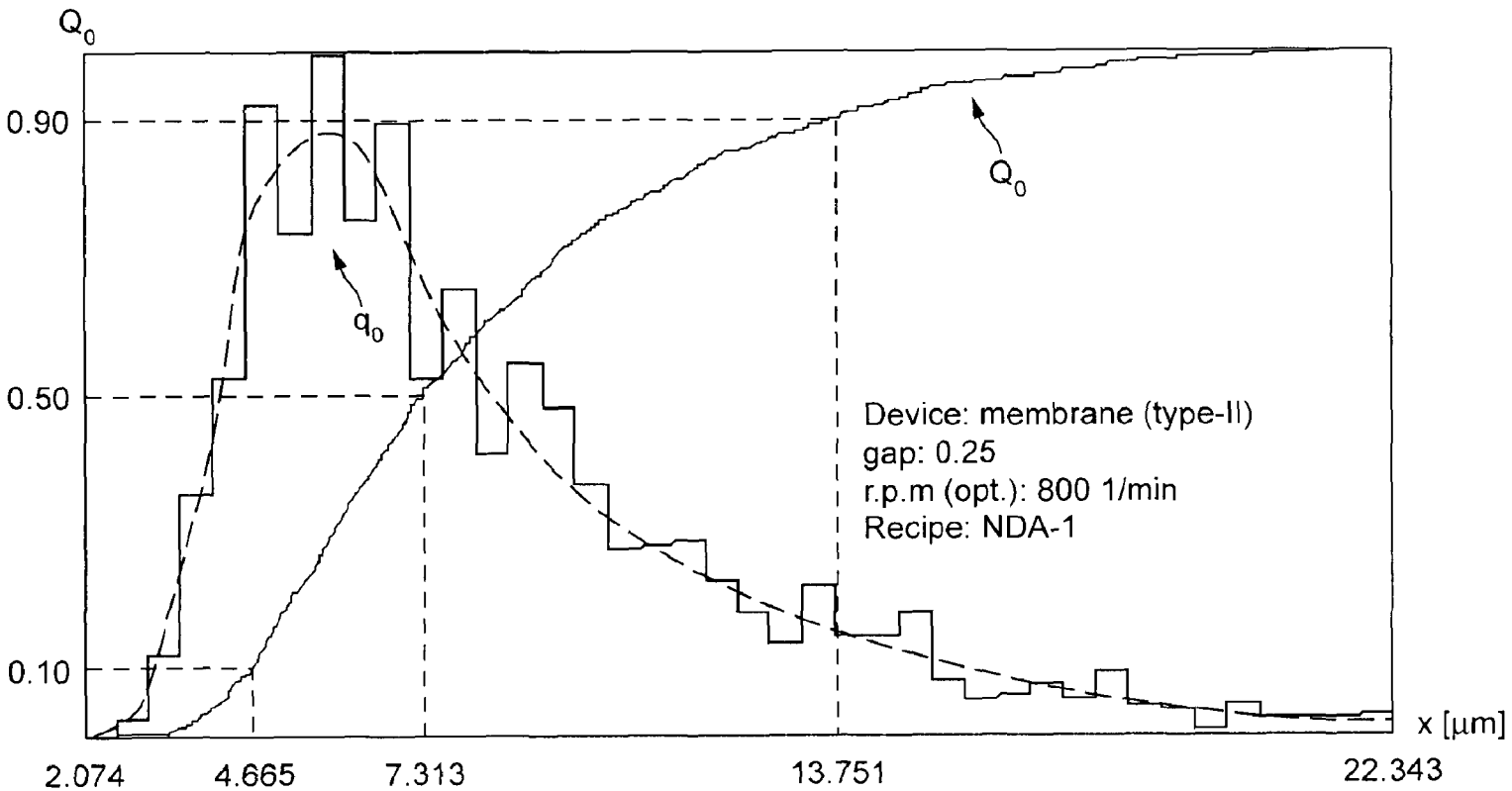
FIG. 16 is a graph of air bubble size distribution function $q_o(x)$ (i.e., number density distribution) after dispersing treatment in the novel membrane device B-Type II with membrane mounted to the fixed housing.
Figure 17:
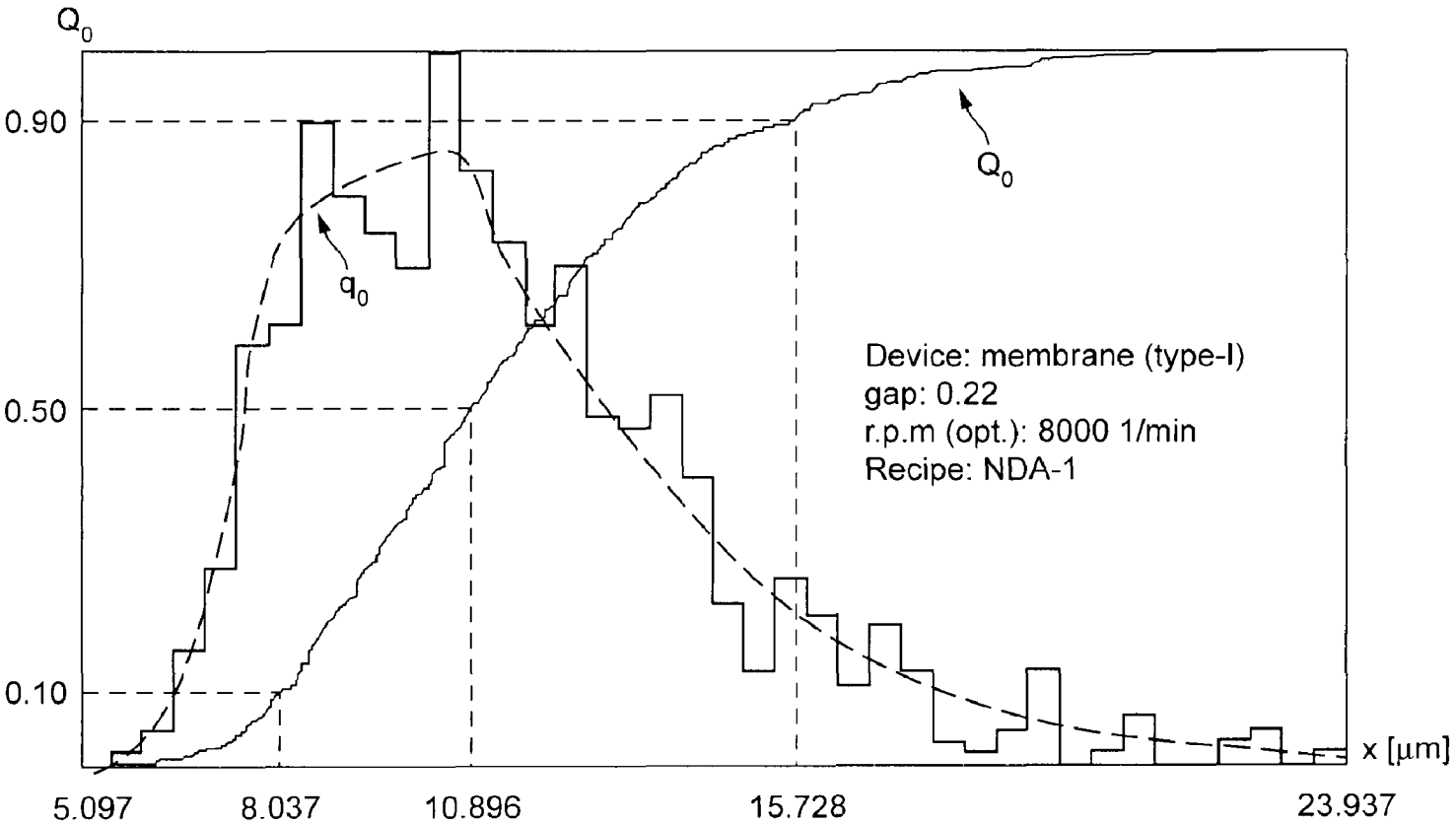
FIG. 17 is a graph of air bubble size distribution function $q_o(x)$ (i.e., number density distribution) after dispersing treatment in the Type II membrane device under the same conditions as the B-Type I device.
Figure 18:
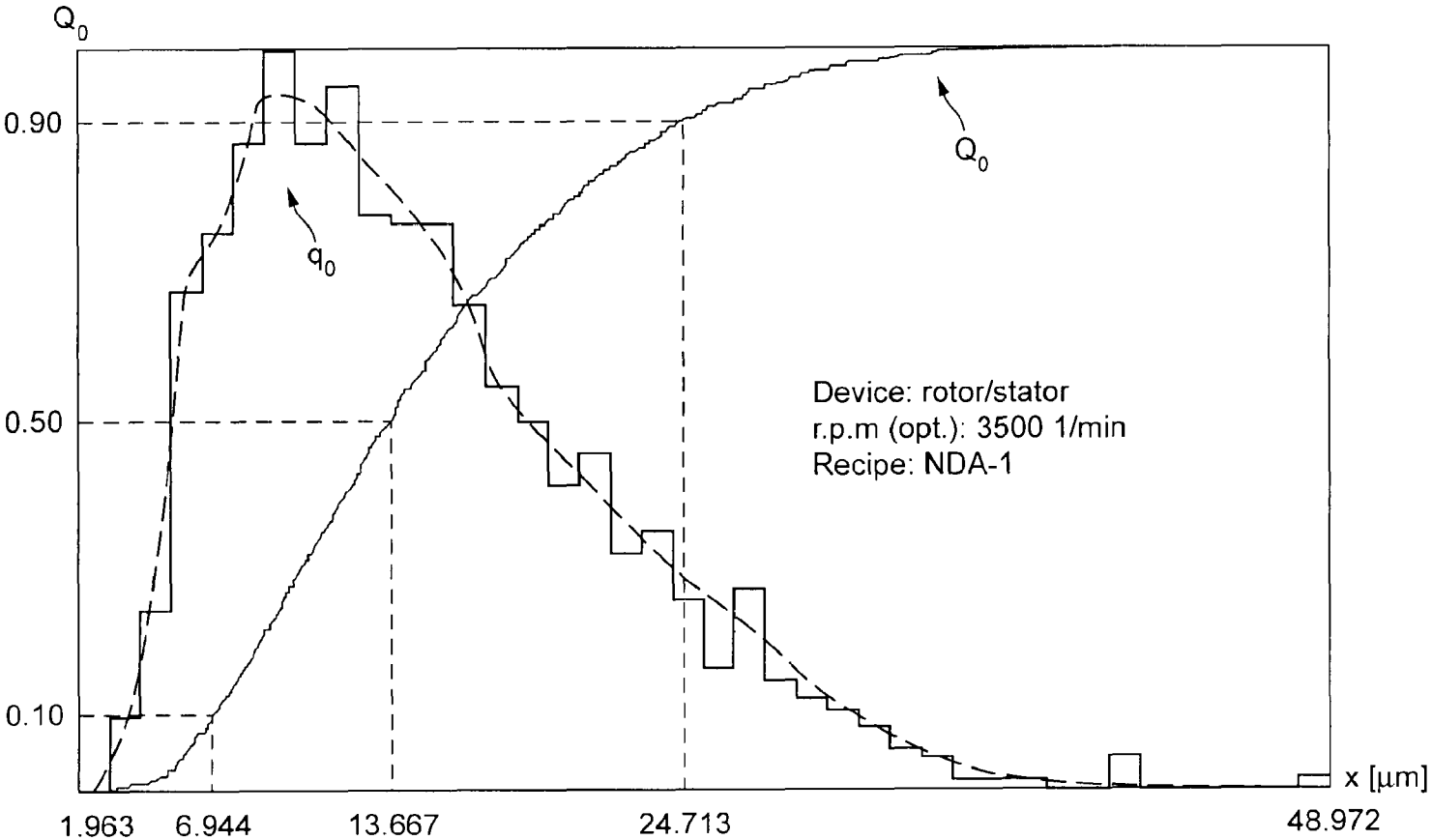
FIG. 18 is a graph of air bubble size distribution function $q_o(x)$ (i.e., number density distribution) after dispersing treatment in a conventional rotor/stator device under the same conditions as the B-Type I and II devices.
Figure 19:
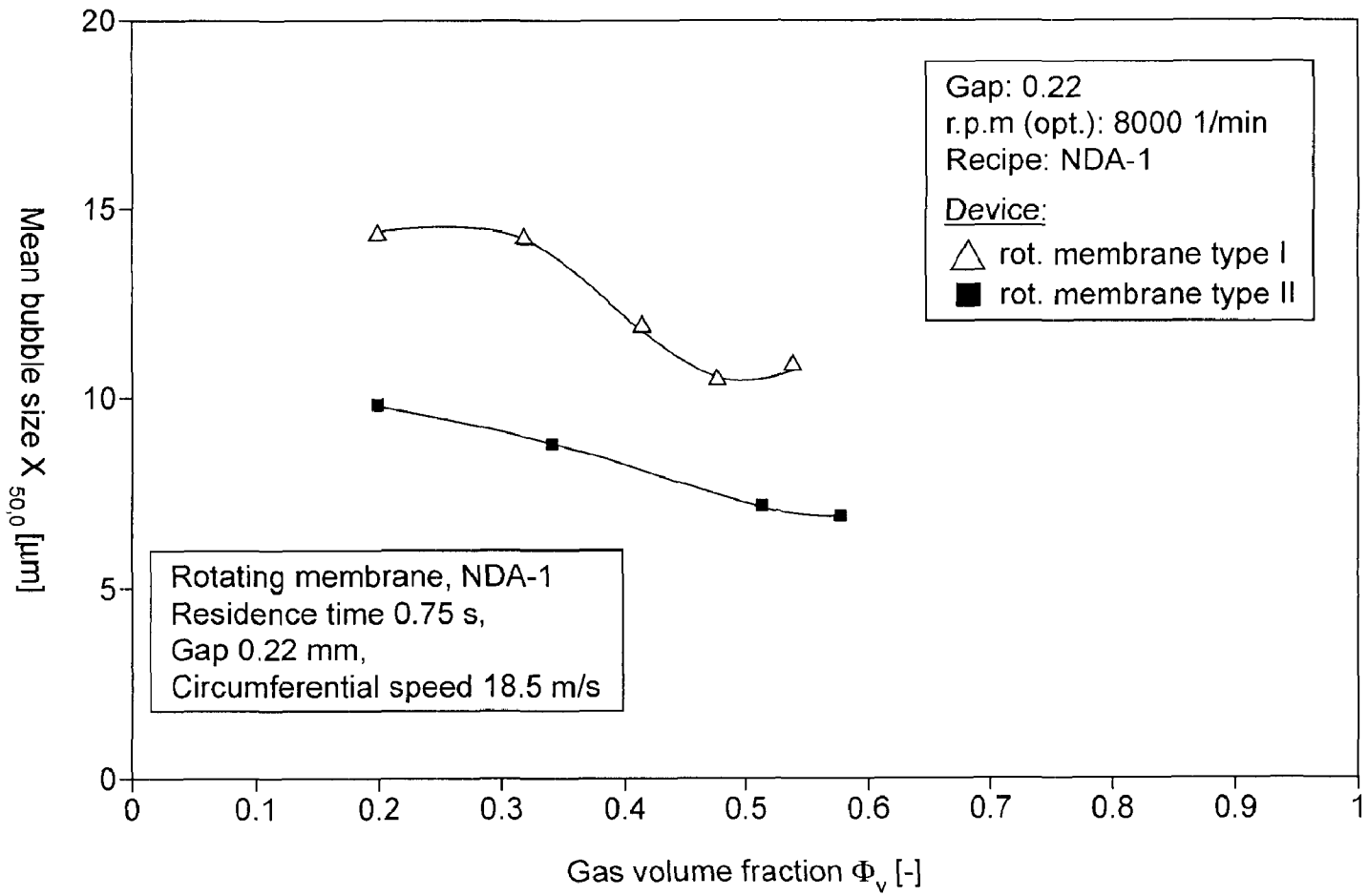
FIG. 19 is a graph showing the functional dependency of the mean bubble diameter $X_{50,0}$ (mean value of the bubble volume distribution, $q_3(x)$) as a function of the dispersed gas at a 30 volume fraction for model recipe NDA-1, aerated with the two different process embodiments: membrane process/device with membrane mounted on rotating inner cylinder (B-Type I) and membrane process/device with fixed membrane at the housing and rotating inner solid cylinder with smooth surface (B-Type II); conditions: recipe NDA-1, gap: 0.22 mm, r.p.m.: 6250).

It can be expected that the shooting mechanism schematically demonstrated in the magnified gap part of FIG. 13A favors to some extent the formation of smaller bubbles where the gas/air filament formed is assumed to be of slender shape when broken up into drops (8) in the dispersing flow. On the contrary, bubble formation at the inner rotating membrane surface can be expected to form more compact gas/air entities with the tendency if detached to form larger gas bubbles or even a gas layer as demonstrated in FIG. 12A. In the latter case bubble formation may take place at the fluid layer surface from which filaments are detached. These tendencies were confirmed by experiments as demonstrated in FIGS. 1, 3, 4, 16, 17 and 18 showing resulting bubble size number distributions (FIG. 1: for membrane mounted on inner rotating cylinder (Type I); FIG. 16: for membrane mounted on fixed housing (Type II)) and mean bubble diameters as function of the gas volume fraction for the two different process/device types BI and BII (FIG. 17) and FIG. 18 for a rotor-stator device. Interestingly at higher gas volume fraction (here: 50% vol.) the mean bubble size reaches the same value. This supports the interpretation that the gas/air bubble detachment/break-up mechanism has approached a common type.

This surprising finding motivated the combination of both process/device types I and II, which means that both, the rotating cylinder and the housing can be equipped with a membrane thus doubling the aeration capacity per dispersing gap volume. The Taylor vortex flow patterns as shown up in FIG. 12 do also occur in the reverse type II construction if a critical Taylor number (e.g., 41.3) is exceeded.

Figure 14B:
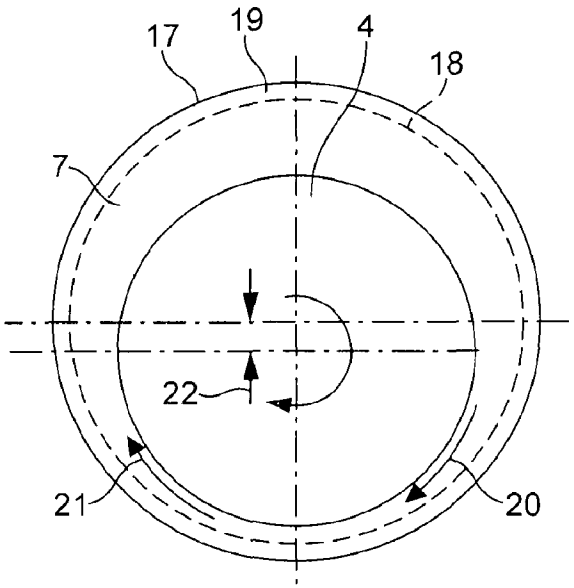
FIG. 14A is a sectional view through the apparatus of FIGS. 12-13, orthogonal to the rotation axis, illustrating the eccentric arrangement of rotating inner part and housing, with FIG. 14B illustrating a sectional view parallel to the rotation axis.
Figure 14A:
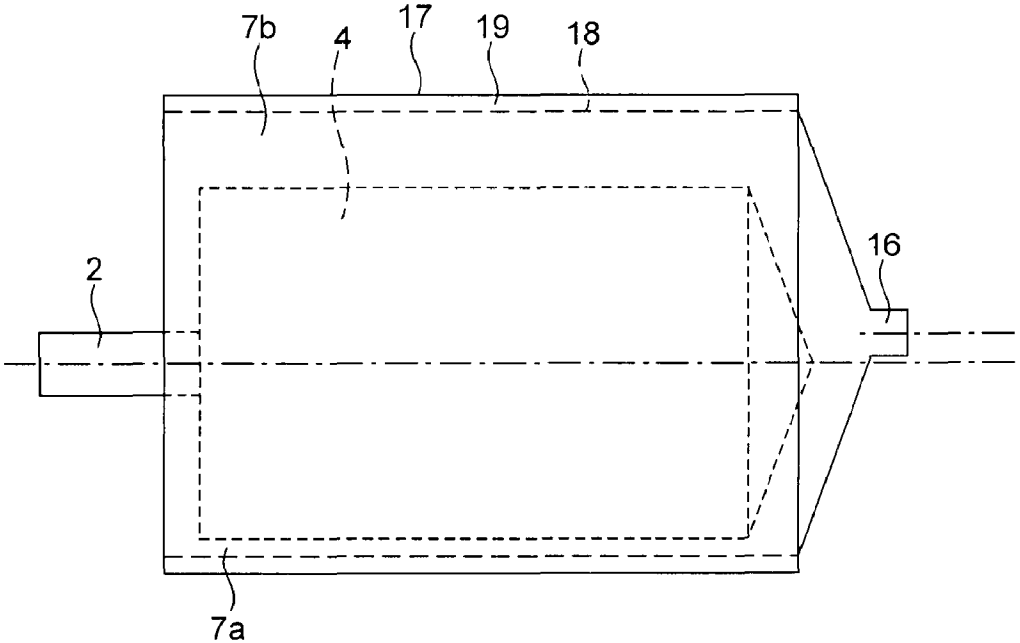

Elongation flow components allowing for increased filament stretching may substantially contribute to further enhance the formation of slender gas/air filaments instead of compact gas/air entities at the membrane surface. In order to implement such elongation flow components the eccentric placement (22) of the rotating inner cylinder within the cylindrical housing is used as shown in FIGS. 14A and 14B. In the contracting gap flow domain the fluid is accelerated in the inflow gap domain (20) allowing for additional gas filament elongation. In the diverging gap flow domain (21) negative elongation equivalent to contraction can support the stretched gas/air filament relaxation thus supporting the generation of so-called Rayleigh instabilities and leading to a wavy filament supporting the break-up into narrowly size distributed dispersed bubbles.

Figure 15B:
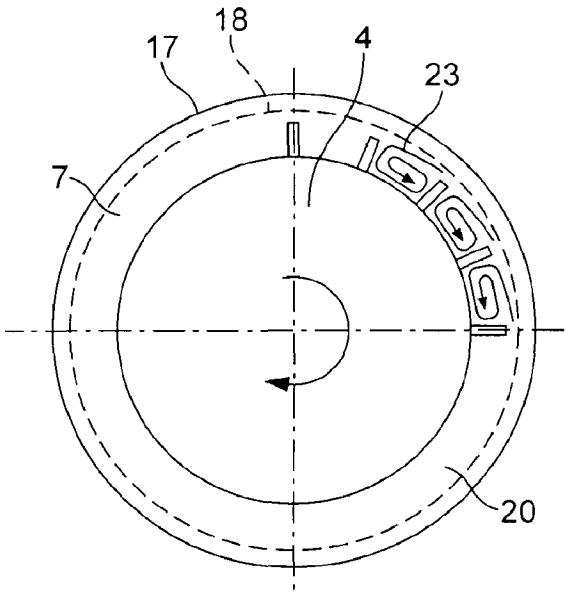
FIG. 15A is a sectional view through the apparatus of FIGS. 12-13, orthogonal to the rotation axis, demonstrating the concentric arrangement of rotating inner part and housing with the aeration membrane fixed to the housing and profiled surface of the rotating inner part (i.e., cylinder), with FIG. 15B illustrating a sectional view parallel to the rotation axis .
Figure 15A:
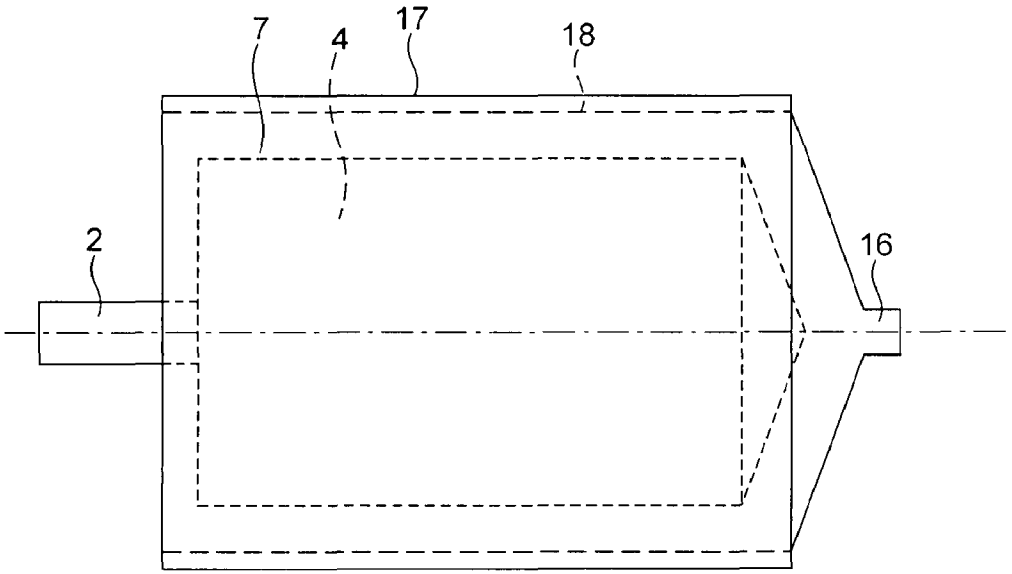

Local periodic elongation and relaxation flow at the membrane surface can also be generated using a profiled surface of the cylinder wall upon which the membrane is not mounted, as demonstrated in FIGS. 15A and 15B for the type II construction of the membrane device. In this case periodic vortices (23) wiping the membrane surface are generated.

Figure 20:
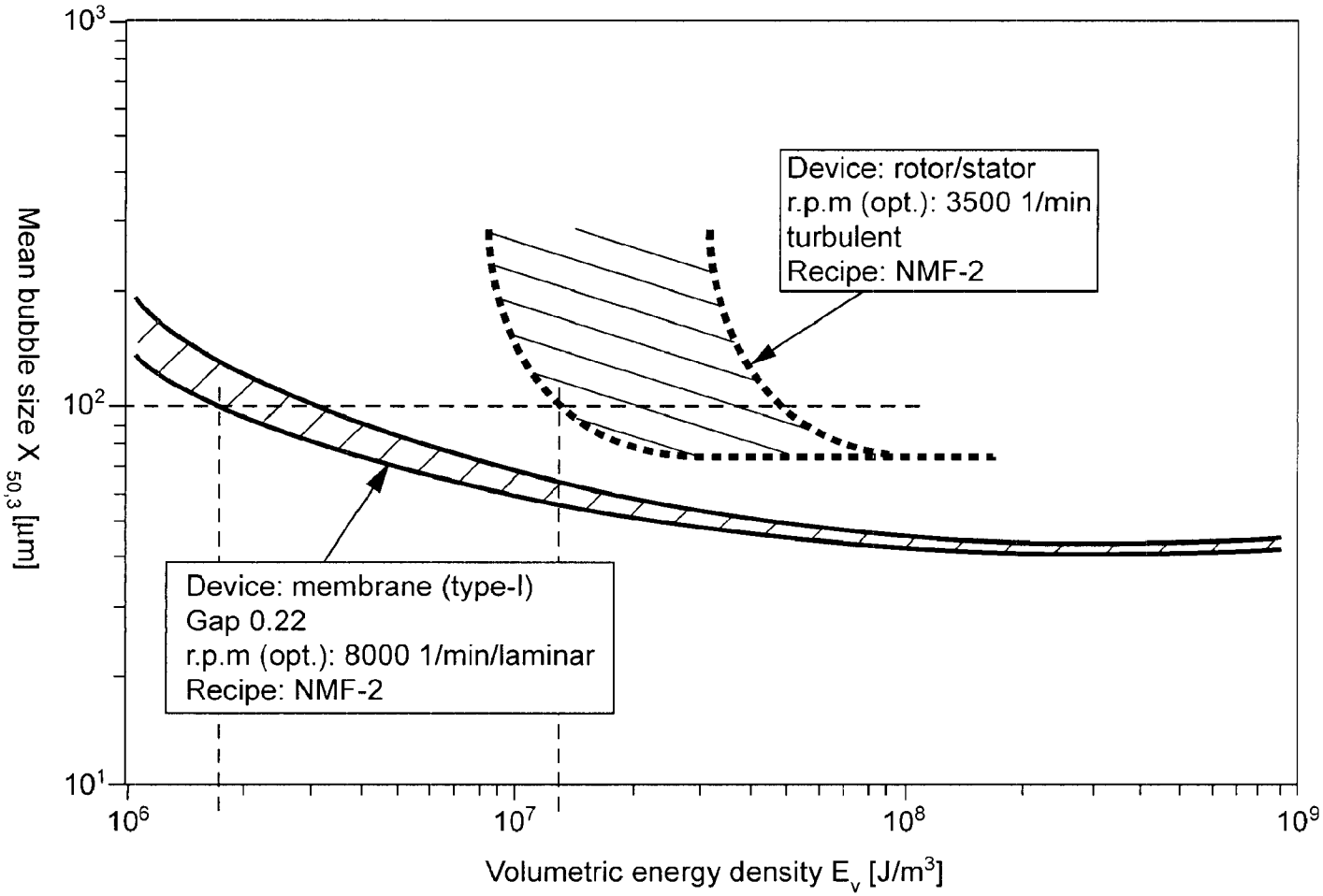
FIG. 20 is a graph showing the functional dependency of the mean bubble diameter $X_{50,0}$ (mean value of the number distribution, $q_o(x)$) as a function of the volumetric energy density (energy input per volume liquid) for continuous liquid fluid phase recipe NMF-2 (2a, 2b comparable) aerated with the two different processes: conventional rotor/stator intermeshing pin with turbulent flow characteristics (A) and novel membrane process/device with the membrane mounted on rotating inner cylinder (B-Type I).

Under comparable circumferential velocity conditions of the rotating part, applied in the foaming experiments with the novel process types I and II (B) for which the bubble size distributions shown in FIGS. 1 and 20 were obtained and using the same whippable model fluid system NDA-I, consisting of a watery model solution with 0.1% of polysaccharide/thickener and 0.6% of surfactant. Foaming experiments have also been carried out using a conventional rotor/stator foaming device from Kinematica AG, Luzern (CH), in which turbulent flow conditions are typically applied. The resulting bubble size number distribution is given in FIG. 2. The direct comparison with FIGS. 1 and 16 shows the clearly coarser and more widely distributed bubble sizes.

This comparison is more pronounced in FIGS. 3 and 4, where characteristic bubble size values like $x_{10,0}$ (i.e., bubble diameter for which 10% of the number of bubbles are smaller), $X_{50,0}$ (i.e., bubble diameter for which 50% of the number of bubbles are smaller), and $x_{90,0}$ (i.e., bubble diameter for which 90% of the number of bubbles are smaller), and the bubble diameter ratio $X_{90,0}/X_{10,0}$ (i.e., indication of the bubble size distribution width or "narrowness" respectively) for the three different aeration process/device versions: conventional rotor/stator intermeshing pin with turbulent flow characteristics (A), novel membrane process/device with membrane mounted on rotating inner cylinder (B, Type 1) and novel membrane process/device with fixed membrane at housing and rotating inner solid cylinder with smooth surface (B, Type II) are compared.

Beside the comparison of the novel process/device types I and II (B) with the conventional rotor/stator process/device (A) at the same circumferential velocity of the rotating elements demonstrated before, a more general comparison of the dispersing/foaming characteristics has been made by plotting the mean bubble diameters as a function of the volumetric energy input into the gas/liquid dispersion within the foaming device. This is shown in FIG. 20 for a second model mix recipe NMF-2 system containing 3% of mills proteins as surfactant and 1.5% of guar gum as stabilizer/thickener (slight modifications of recipes NMF-2a and NMF-2b, but comparable rheological behavior; higher viscosity compared to model mix recipe NDA-1 and consequently larger resulting gas bubble diameters). The novel rotating membrane system (e.g. type I in FIG. 20) consumes much less energy (a factor of 5-7 times less) per volume foam product (for constant dispersed gas fraction of 50% vol.) compared to the conventional process/device (A).

Furthermore, for the same minimum required volumetric energy input of about $3\times10^7$ J/m$^3$ to get the minimum possible mean bubble size of the volume distribution ($q_3(x)$) of about $X_{50,3}$; ≈70-75 microns in the conventional process/device (A) (limitation due to the centrifugal de-mixing at increased energy input/rotational velocity) the novel process device reaches $x_{50,3}$; ≈40-45 microns (≈40% reduced size).

Figure 21:
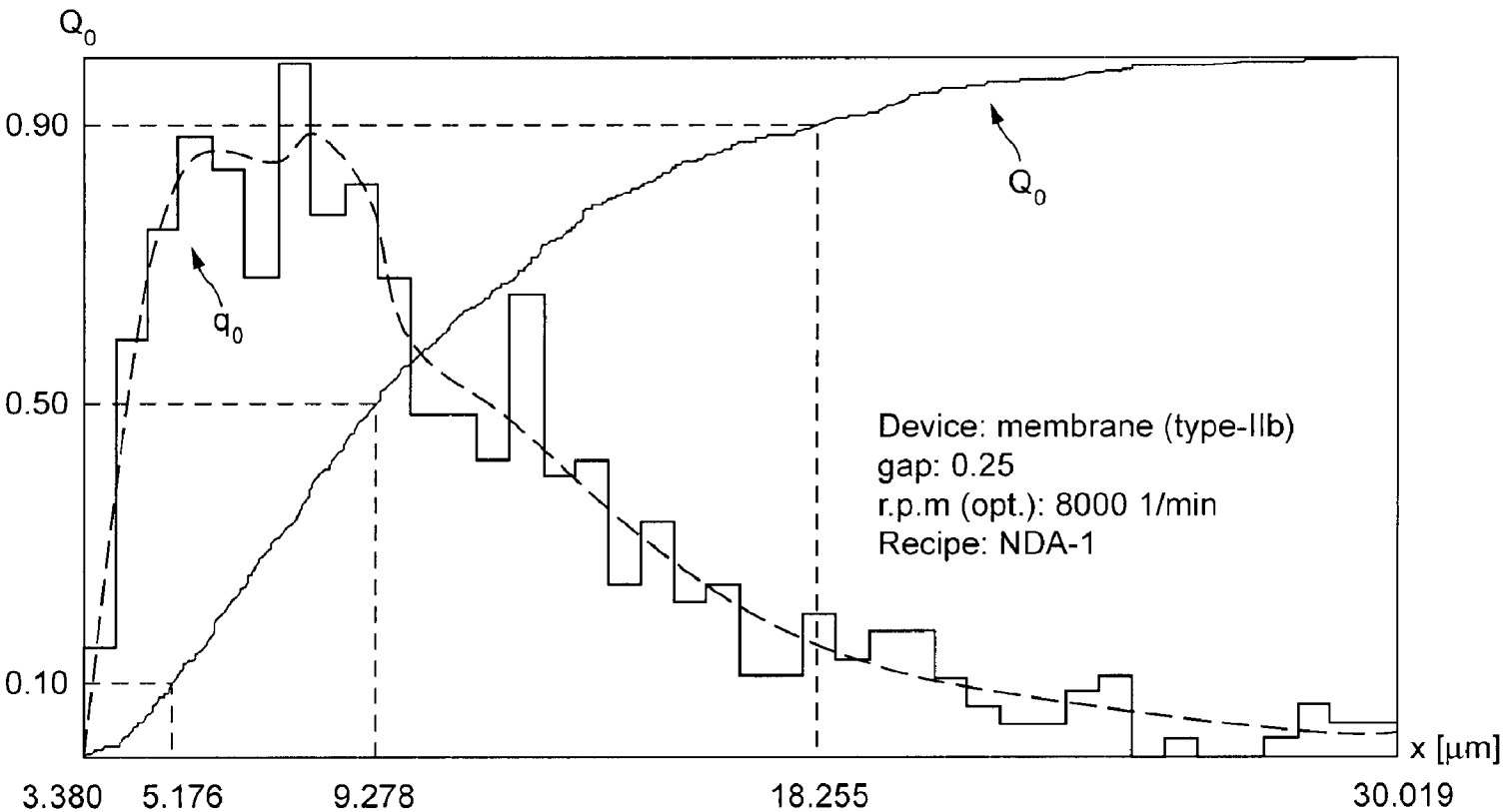
FIG. 21 is a graph of air bubble size distribution function $q_o(x)$(=number density distribution) after dispersing treatment in novel membrane device with membrane mounted to the fixed outer housing and with profiled surface of rotating inner cylinder (conditions: recipe NDA-1, gap: 0.22 mm, r.p.m.: 6250, gas volume fraction 0.5).

In FIG. 21 again the number distributions of the model mix recipe NDA-1 is shown, aerated within a type-II rotation membrane device (membrane mounted at the outer, fixed wall), however with additionally profiled surface of the inner cylinder/denoted as type II b. The results are compared with FIGS. 1, 16, and 2. When compared to FIGS. 1, 16, and 2, the comparison shows, that the type II b construction also provides clearly finer and more narrowly distributed bubbles than the rotor/stator device (FIG. 2) and also finer than the type I rotating membrane device (FIG. 16), but worse than the type II rotating membrane device without profiled inner cylinder wall (FIG. 1).

As noted herein, the foams of the invention may be used to make various products including those that are edible. Such products include frozen products such as ice creams, sorbets or other novelties, refrigerated foodstuffs such as whipped puddings, cream cheeses, dessert toppings and the like, or even heated food products such as creamed soups, sauces, gravies and the like.

The edible foams of the invention may also include edible additives such as herbs, spices, pieces of breads, meats, vegetables, or inclusions such as nuts, fruits, cookie pieces, candy or the like as desired for the type of food product. In addition, syrups, toppings, semisolid materials, such as marshmallow, peanut butter, fudge or the like can also be included when desired. For the most preferred embodiment of ice cream, the additive can be used in the same way as in conventional ice cream manufacture. If it is desired to suspend the additive into the foam, it is possible to process the component to impart a similar density to that of the foam so that the additive does not sink to the bottom of the foam due to gravity when the matrix is in a liquid state. Also, additives with the same density as the foam remain in place after mixing and before freezing of the foam. One conventionally known procedure for reducing the density of an additive is by aeration or similar foaming techniques. This also reduces the cost of the final product since for the same volume the weight of the component or additive is reduced.

The present foams facilitate the manufacture of low cost, low calorie, easy to manufacture foodstuffs that provide heath or nutritive benefits to the consumer. Furthermore, these foodstuffs can be made at any temperature from temperatures where the matrix is frozen to higher temperatures where it is liquid. Thus, products can be stored, shipped or consumed at room temperatures, lower temperatures or even at higher temperatures provided that the matrix is not heated above its boiling point where significant evaporation can cause loss of the foam. Such products can be made fat-free with a clean and quick melt off or disintegration in the mouth, thus providing a clean flavor profile or characteristic. Moreover, these foams provide a creamy mouthfeel without the addition of a fatty component. This allows the foam to have a low caloric density, on the order of 240 to 250 to perhaps as high as 300 Kcal/100 ml bubble-free serving size, which renders most if not all products eminently suitable for the low fat/low calorie market. In addition, these products can be made protein and allergen free as no dairy components are required. This results in a low hygiene risk so that the products can be stored at room temperature until consumption. Even without a dairy component, these products provide a creamy, clean, quick melting mouthfeel which is desirable and palatable to consumers. The small air bubbles in the foam act like small ball bearings to lubricate the palate of the consumer.

The foam creates an entirely new way to manufacture ice cream products. The foam can be manufactured and stored at room temperature until desired to be frozen to form the ice cream. In the manufacturing process, a generic foam can be made which can then be processed into the desired flavors formulations and placed into containers that can be shipped, sold and stored at room temperature. This process would be similar to what is currently available for manufacturing paints, where a base is made and the color is added to it upon demand. Similar advantages are available for the manufacture of ice creams, since at the factory, different flavors or formulations can be made as desired. In fact, it is now possible for the stores to make up and sell to the consumer the specific flavor or formulation that they want when purchasing the product. The product is sold with the foam at room temperature so that it is east to transport home and store until use. When an ice cream is to be consumed, the consumer simply needs to place it in the freezer for an hour or two to allow the matrix to freeze. Thereafter, it can melt and be stored at room temperature.

As will be understood by those skilled in the art, other equivalent or alternative methods and devices for the formation of the novel edible foamed product according to the embodiments of the present invention can be envisioned without departing from the essential characteristics thereof. Accordingly, the foregoing disclosure is intended to be illustrative, but not limiting, of the scope of the invention which is set forth in the following claims.

What is claimed is:

1. A process for making a foam having a controlled size distribution of gas bubbles in a liquid matrix, which comprises:

passing a flow of a gas to and through a porous metal membrane configured in the shape of a cylinder of uniform diameter and having a controlled pore size and a controlled pore distance that is at least 3 to 5 times the average pore diameter to produce a substantially uniform size distribution of gas bubbles;

passing a flow of liquid matrix past the porous metal membrane to collect, accumulate, detach and entrain the gas bubbles in the liquid matrix to form a foam having gas bubbles of generally uniform size and a substantially uniform gas bubble size distribution; wherein the liquid flow passes through a gap of constant width between the porous metal membrane and a housing wall surface to carry the bubbles away, with the gap having a width in the range of 0.1 to 10 millimeters; and rotating the cylinder, the wall surface or both in order to detach the gas bubbles from the porous metal membrane surface and to entrain the gas bubbles in the liquid matrix.

2. The process of claim 1 which further comprises providing a gas pumping device to provide the gas flow; providing a fluid pumping device to provide the liquid matrix flow, and selecting, separately or in combination, the pore size or pore distance of the porous metal membrane, the gas flow from the gas pumping device and the liquid flow from the fluid pumping device to provide gas bubbles having a mean diameter $X_{50,0}$ that is in the range of 1.5-2.5 times the mean pore diameter Xp to provide the foam with a gas bubble diameter distribution ratio $X_{90,0}/X_{10,0}$ that is less than 5.

3. The process of claim 1, wherein the flow of liquid past the porous metal membrane is provided with a variable, adjustable circumferential velocity and is directed close to the surface of the porous metal membrane.

4. The process of claim 1, conducted to provide gas bubbles having a mean diameter $X_{50,0}$ that is in the range of 1.25-1.5 times the mean pore diameter Xp and the foam has a gas bubble diameter distribution ratio $X_{90,0}/X_{10,0}$ that is less than 3.

5. The process of claim 1, wherein the liquid matrix comprises water, the gas is air, and the foam has a bubble diameter distribution ratio $X_{90,0}/X_{10,0}$ that is less than 2.

6. The process of claim 1, wherein the cylinder is rotated at a circumferential velocity of 1 to 40 m/s, with the rotating exterior surface of the cylinder in connection with the passing liquid matrix dislodging the gas bubbles and entraining them in the liquid matrix.

7. The process of claim 1, wherein the porous metal membrane through which the gas passes is an interior surface of a metal membrane cylinder and wherein the wall surface is part of a rotating element in the form of a non-membrane cylinder which is located within the porous metal membrane cylinder.

8. The process of claim 7, wherein the non-membrane cylinder has a smooth surface and is located concentrically within the porous metal membrane cylinder.

9. The process of claim 7, wherein the non-membrane cylinder has a structured surface consisting of axially oriented or spiral cuts with a cut depth to narrowest gap ratio of 1/10 to 1/2.

10. The process of claim 7, which further comprises adjustably selecting gas bubble size or size distribution by controlling the flow of the liquid matrix at a variable, adjustable mass flow rate, controlling the gas flow through the porous membrane at a variable, adjustable trans-membrane pressure and gas volume- or mass flow rate, or rotating the porous membrane cylinder with a variable, adjustable circumferential velocity to provide adjustability in the selection of the gas bubble size or size distribution.

11. The process of claim 10, wherein the desired gas bubble size and gas bubble size distribution are attained within a range of disperse gas volume fractions of 20 to 70% which are equivalent to overruns of 25 to 230%.

12. The process of claim 7, which further comprises rotating either of the membrane cylinder or the non-membrane cylinder, causing advantageous Taylor vortex flow patterns which facilitate bubble detachment from the membrane surface demonstrated by mean bubble diameters in the range below 1.25 times the mean pore diameter Xp.

13. The process of claim 7, which further comprises directing the flow of gas to and through the porous metal membrane by a gas pumping device to form the gas bubbles; and directing the flow of liquid matrix past the porous metal membrane by a fluid pumping device.

14. The process of claim 13, wherein the pore size of the porous metal membrane, the gas flow from the gas pumping device and the liquid flow from the fluid pumping device cooperate to provide gas bubbles having a mean diameter $X^{50,0}$ that is in the range of 1.5-2.5 times the mean pore diameter Xp and to provide the foam with a gas bubble diameter distribution ratio $X_{90,0}/X_{10,0}$ that is less than 5.

15. The process of claim 13, which further comprises rotating the housing wall surface with variable, adjustable circumferential velocity close to the surface of the porous metal membrane.

16. The process of claim 13, wherein the gas bubbles have a mean diameter $X_{50,0}$ that is in the range of 1.25-1.5 times the mean pore diameter Xp and the foam has a gas bubble diameter distribution ratio $X_{90,0}/X_{10,0}$ that is less than 3.

17. The process of claim 13, wherein the liquid matrix comprises water, the gas is air, and the foam has a bubble diameter distribution ratio $X_{90,0}/X_{10,0}$ that is less than 2.

18. The process of claim 13, wherein the porous membrane has pore diameters Xp ranging from 0.1 to 10 microns; and an average pore diameter; and a pore size distribution characterized by a maximum to minimum pore diameter ratio of less than 1.5.

19. The process of claim 1, which further comprises at least one drive member for rotating the cylinder or housing, or both in order to detach the gas bubbles from the porous metal membrane surface and to entrain the gas bubbles in the liquid matrix.

20. The process of claim 19, wherein the cylinder surface where the gas bubbles are formed is an exterior surface of the cylinder, the adjacent wall of the housing is an inner wall, the porous membrane cylinder is rotated, and the drive member provides rotation at a circumferential velocity of 1 to 40 m/s, with the rotating exterior surface of the cylinder in connection with the passing liquid matrix dislodging the gas bubbles and entraining them in the liquid matrix.

21. A process for making a foam having a controlled size distribution of gas bubbles in a liquid matrix, which comprises:

passing a flow of a gas to and through a porous material having a controlled pore size to produce a substantially uniform size distribution of gas bubbles, wherein the cylinder surface where the gas bubbles are formed is an interior surface of the membrane cylinder and a rotating element; and passing a flow of liquid matrix past the porous material to collect, accumulate, detach and entrain the gas bubbles in the liquid matrix to form a form having gas bubbles of generally uniform size and a substantially uniform gas bubble size distribution;

wherein the non-membrane cylinder as the rotating element is located eccentrically within the membrane cylinder, forming a gap having a width ratio of largest gap width to smallest gap width of 1.1 to 5 to provide adjustability in the selection of the gas bubble size or size distribution.

22. The process of claim 21, which further comprises at least one drive member for rotating the rotating element or the membrane cylinder, or both in order to detach the gas bubbles from the porous membrane surface and to entrain the gas bubbles in the liquid matrix.

23. The process of claim 21, wherein the inner non-membrane cylinder has a smooth surface.

24. The process of claim 21, wherein the inner non-membrane cylinder has a structured surface consisting of axially oriented or spiral cuts with a cut depth to narrowest gap ratio of 1/10 to 1/2.

25. The process of claim 13, wherein either the fluid pumping device provides a variable, adjustable mass flow rate of the matrix liquid, the gas pumping device directs the gas through the membrane with a variable, adjustable trans-membrane pressure and gas volume- or mass flow rate, or the rotating element rotates with a variable, adjustable circumferential velocity to provide adjustability in the selection of the gas bubble size or size distribution.

26. The process of claim 21, wherein the membrane cylinder and rotating element are spaced by a narrow gap therebetween wherein the gap is of variable width in the range of 0.1 to 10 millimeters and the porous membrane is made of a metal, ceramic, glass, polymer or rubber material and has pore diameters Xp ranging from 0.1 to 10 microns.

27. The process of claim 21, which further comprises directing the flow of gas to and through the porous membrane by a gas pumping device to form the gas bubbles; and directing the flow of liquid matrix past the porous membrane by a fluid pumping device.

* * * * *

UNITED STATES PATENT AND TRADEMARK OFFICE

CERTIFICATE OF CORRECTION

PATENT NO. : 8,231,263 B2
APPLICATION NO. : 12/374284
DATED : July 31, 2012
INVENTOR(S) : Windhab et al.

It is certified that error appears in the above-identified patent and that said Letters Patent is hereby corrected as shown below:

Title Page:
Item (75) Inventors, after "Nadia Patrizia Müller-Fischer," change "Satfen" to -- Stafa --.

Column 37:
Line 10 (claim 14, line 5), change "$X^{50,0}$" to -- $X_{50,0}$ --.

Signed and Sealed this
Eleventh Day of September, 2012

David J. Kappos

David J. Kappos
*Director of the United States Patent and Trademark Office*